US010465454B2

(12) United States Patent
Curry

(10) Patent No.: US 10,465,454 B2
(45) Date of Patent: Nov. 5, 2019

(54) ALTERNATIVE LOCKING ARRANGEMENTS FOR TUBULAR CONNECTIONS

(71) Applicant: Britannia Engineering (Isle of Man) Limited, Isle of Man (GB)

(72) Inventor: Peter Curry, Surrey (GB)

(73) Assignee: BRITANNIA ENGINEERING (ISLE OF MAN) LIMITED, Isle of Man (GB)

( * ) Notice: Subject to any disclaimer, the term of this patent is extended or adjusted under 35 U.S.C. 154(b) by 160 days.

(21) Appl. No.: 15/570,302

(22) PCT Filed: Apr. 29, 2016

(86) PCT No.: PCT/GB2016/051255
§ 371 (c)(1),
(2) Date: Oct. 27, 2017

(87) PCT Pub. No.: WO2016/174473
PCT Pub. Date: Nov. 3, 2016

(65) Prior Publication Data

US 2018/0128063 A1 May 10, 2018

(30) Foreign Application Priority Data

Apr. 30, 2015 (GB) ..... 1507389.3

(51) Int. Cl.
*E21B 19/12* (2006.01)

(52) U.S. Cl.
CPC ..... *E21B 19/12* (2013.01)

(58) Field of Classification Search
USPC ..... 248/62
See application file for complete search history.

(56) References Cited

U.S. PATENT DOCUMENTS 4,406,485 A * 9/1983 Giebeler ..... E21B 33/13 285/391
4,497,592 A 2/1985 Lawson
(Continued)

FOREIGN PATENT DOCUMENTS

EP 0326299 A1 8/1989
GB 2185847 7/1987
(Continued)

OTHER PUBLICATIONS

International Patent Application No. PCT/GB2016/051255, International Search Report and Written Opinion dated Oct. 14, 2016.
(Continued)

*Primary Examiner* — Monica E Millner
(74) *Attorney, Agent, or Firm* — Leber IP Law; Celia H. Leber

(57) ABSTRACT

There is provided a system for preventing the movement of a clamping member, the system comprising a clamping member in moveable association with a first member, and at least one locking member moveably associated with said first member and said clamping member, wherein when said clamping member is moved towards the longitudinal axis of said first member, said at least one locking member is moveable towards the clamping member in order to prevent said clamping member from moving away from said longitudinal axis to its initial position.

20 Claims, 19 Drawing Sheets

(56) References Cited

U.S. PATENT DOCUMENTS

| | | | | |
|---|---|---|---|---|
| 5,071,175 | A * | 12/1991 | Kennedy, Jr. | F16L 21/08 285/337 |
| 7,578,932 | B2 * | 8/2009 | Cantolino | F25D 21/14 137/268 |
| 7,861,982 | B1 * | 1/2011 | McClure | F16L 3/1075 248/229.14 |
| 8,500,371 | B2 * | 8/2013 | Curry | F16L 39/005 166/382 |
| 8,978,768 | B2 * | 3/2015 | Curry | E02D 29/0258 166/338 |
| 2002/0117587 | A1 * | 8/2002 | Tenma | F16L 3/105 248/49 |
| 2007/0214670 | A1 * | 9/2007 | Wrzyszczynski | E21B 33/035 33/412 |

FOREIGN PATENT DOCUMENTS

| | | | |
|---|---|---|---|
| GB | 2332256 | A | 6/1999 |
| GB | 404092 | | 1/2005 |
| GB | 2496647 | A | 5/2013 |
| GB | 2468368 | B | 2/2014 |
| WO | 2009027694 | A2 | 3/2009 |
| WO | 2010100473 | A | 9/2010 |

OTHER PUBLICATIONS

International Patent Application No. PCT/GB2016/051255, International Preliminary Report on Patentability dated Mar. 21, 2017.

* cited by examiner

ALTERNATIVE LOCKING ARRANGEMENTS FOR TUBULAR CONNECTIONS

RELATED APPLICATIONS

This application is a national phase entry of International Patent Application No. PCT/GB2016/051255, filed Apr. 29, 2016, which claims the benefit under 35 U.S.C. § 119(e) to Great Britain Patent Application No. 1507389.3, filed Apr. 30, 2015, the entire contents of which is hereby incorporated by reference.

TECHNICAL FIELD OF THE INVENTION

This invention relates to alternative locking arrangements for tubular connections. In more detail, the invention relates to the use of locking members (preferably threaded) to maintain a clamping force applied by a clamping member associated with an outer tube to an inner tube lying within the outer tube. The invention also relates to a lightweight tool that can be used in subsea operations in order to apply pressure to a clamping member to clamp two tubes together.

BACKGROUND

There are known methods of securing tubular members together in a subsea or hostile remote environment. Existing methods include those described in granted United Kingdom Patent Publication Nos 2185847B 'Interfitting Tubular Members' and 2404092B and 2468368B 'Improvements in and Relating to Clamping Arrangements'. See also International patent applications published as WO2009/027694 and WO2010/100473. These known methods utilise a single pad to exert a clamping load between the inner and outer tubular member and thereby generate frictional resistance that are able to transfer structure loads safely from one to another. The subjects described here involve features used in an alternative connector locking arrangement and the tool associated with the load application.

The method of locking is an important consideration as this is used to ensure the clamping load is both reliable and ideally releasable throughout the lifetime of the connector. The methods are suitable for a range of conditions and loads and also suitable for both manual or diver operation and also for operations using Remotely Operated Vehicles or ROVs. Due to the costly nature of subsea operations there is advantage in using an operation that is simple, quick and ideally releasable. The ability to release the connection is of particular value as should the subsea structure or equipment require maintenance or replacement then release of the connection would allow recovery of the element and later reinstatement. The connectors are permanent feature that are mounted on the surface of the outer tubular and therefore need to be of a suitable profile to minimise the potential for snagging of wires and or controls or life support umbilicals used during installation or maintenance of the structure by both divers and ROVs.

SUMMARY OF THE INVENTION

A tool to operate (engage and disengage) the connection would ideally be able to be positioned, operated and recovered by either diver and or ROV. It will therefore need to be sufficiently powerful to generate the required large clamping loads but ideally have a low submerged weight and have a sympathetic shape to permit easy handling manoeuvrability and operation subsea.

The present connector locking device and tool arrangements are intended satisfy the above requirement.

In the following embodiment descriptions the term horizontal or vertical are used for convenience to describe the typical orientation of the arrangement. It should be understood that the actual orientation may be varied to suit the application and these terms may thus be considered interchangeable.

The present invention provides a system for preventing the movement of a clamping member, the system comprising:

a clamping member (e.g. a pad or the like) in moveable association with a first member (e.g. an outer tube or the like), said first member having a longitudinal axis and wherein said clamping member is moveable towards and away from said axis;

at least one locking member (e.g. one or more locking pins) moveably associated with said first member and said clamping member;

wherein said at least one locking member is moveable towards the clamping member in order to prevent said clamping member from moving away from said longitudinal axis to its initial position.

Preferably the initial clamping application is delivered via a Thrust Rod and the locking members (e.g. Locking Pins) subsequently carry the clamping load passively.

In this regard, therefore, there is provided an arrangement wherein said at least one locking member is moveable towards the clamping member after the clamping member has been moved towards the longitudinal axis of the first member.

In an alternative arrangement it could be that the clamping load may be applied directly via the locking member(s) (e.g. threaded pins). This could be achieved by applying (heavy) torque to the threaded pins and effectively driving the pad towards the inner tubular.

In this regard, therefore, there is provided an arrangement wherein said at least one locking member is moveable towards the clamping member to effect movement of the clamping member towards the longitudinal axis of the first member. In other words, the locking member(s) directly act on the pad to force the pad towards an inner tubular. In this regard, 'directly act' does not necessarily mean that there is direct and uninterrupted contact between e.g. the shaft of the locking member and the pad. There may be one or more intermediate members between the two. However, the movement of the locking member directly results in a movement of the clamping member.

It has been found advantageously that an arrangement having a pair of locking members acts to trap efficiently the clamping force applied via a clamping member (pad).

There is therefore provided a system wherein said at least one locking member is a pair of locking members.

Preferably the locking members are coincidental (in line with) with a thrust rod (where present).

It has also been found that a radial arrangement of a pair of locking member acts to trap even more efficiently (as compared e.g. to an axial arrangement) the clamping force of the clamping member.

There is therefore provided a system wherein said pair of locking members are positioned in the same, or substantially the same, plane perpendicular to the longitudinal axis of the first member (i.e. an axial plane).

Nevertheless, there are certain applications that would also benefit from an axial arrangement of locking pins.

There is therefore provided a system wherein said pair of locking members are positioned in the same, or substantially the same, plane parallel to the longitudinal axis along the first member (i.e. a radial plane).

Again, where there is a pair of locking members it has been found that efficient clamping force is achieved where the locking members are (preferably each) positioned so that they lie on a radial line emanating at right angles from the longitudinal axis of the first member.

Preferably, the longitudinal axes of each of said pair of locking members are positioned so that they intersect substantially along the longitudinal axis of the first member.

In an alternative arrangement, the at least one locking member (e.g. single member, or multiple (e.g. two) members) can be orientated orthogonally to the longitudinal axis of the first member and not be radial to it. Such an arrangement may also require a profiled tail portion of the at least one locking member (i.e. the portion in contact with the clamping member) in order to maximise contact area with the clamping member or with an inner tube if no clamping member is present. The profiled tail portion may be a separate part from the shaft of the locking member, so as to accommodate any rotation of the shaft of the locking member during locking/clamping. Alternatively, the clamping member may be modified so that its outer face in contact with the locking member comprises a receiving portion for the locking member (e.g. a cup) which is able to receive the orthogonally orientated locking member and maximise force transmitted to the clamping member.

In arrangements comprising a thrust rod/pin (which transmits the force of a pressure inducing member to the clamping member so as to move the clamping member towards the inner (second) member), the pair of locking members are preferably positioned so that their longitudinal axes intersect substantially along the longitudinal axis of the thrust pin.

In some aspects, the tail portion of the at least one locking member (i.e. the portion in contact with the clamping member) has a convex/concave profile, wherein said tail portion interacts with a complementary concave/convex profiled part, respectively, of the clamping member in order to accommodate misalignment between the locking member and the clamping member. The tail portion may be integral with a shaft of the locking member, or may comprise a separate part on which the shaft of the locking member acts.

In order to prevent unwanted jamming of the system during installation and retrieval, it is an option that the at least one locking member comprises a plurality of parts.

In situations where said plurality of parts are in moveable association with each other, this allows the locking member to articulate.

It has been found that use of threaded portions of the locking member allows accurate and significant force to be maintained in the locking member again the clamping member.

Thus, it is preferred that the at least one locking member comprises at least a portion that is threaded, said threaded portion corresponding to a complementary threaded portion on at least one locking frame associated with said first member, and/or on said first member.

In some arrangements of the present invention there is provided a collar affixed to the inner face of the outer (first) member. This acts to provide support at the or each location opposite the said clamping member.

This is so designed to maintain the circularity of the inner tube so that the inner tube when unclamped may be withdrawn from the outer tube or vice versa with the tubes being caused to jam against each other.

One or more edges of the collar can be tapered in order to facilitate entry of the second member.

Preferably said clamping member is formed from at least a part of said collar.

Preferably the clamping member when viewed from the side is either round, square or rectangular. It is curved in plan, viewed axially along the length of the collar to match the shape of the inner tube. The clamping member is preferably of substantial thickness similar to the thickness of the collar and therefore able to sit within the thickness of the collar thereby allowing uninterrupted passage of the inner tube through the outer tube and collar without contacting the surface of the clamping member.

In order to prevent any significant movement of the clamping member other than in a direction perpendicular to the longitudinal axis of the first member, the collar or clamping member further comprises an arrangement of spacer plates.

In alternative arrangements, there may be no internal collar present. In such situations, the clamping member (e.g. pad) can be formed from part of the first member (outer tubular) rather than the collar. The situation where there is no separate collar and the pad is set within the outer tubular is mentioned in GB2404092B (see FIGS. 27, 28 and claim 11 and related description, incorporated herein by reference).

For example, the permanently attached portion (such as the locking frame and/or reaction plate) can be arranged in a manner whereby the Collar is integrated with or attached directly to the outer sleeve, thereby avoiding the need for the outer sleeve over the height of the collar. This may allow significant material and fabrication cost savings. It is recognized that the effective removal of a relatively large portion of the outer tubular in the form of the pad may adversely affect the strength of the sleeve and as a result (heavy) radial stiffener plates can be added to reinforce the collar portion. This embodiment without an outer sleeve (i.e. outer member) over the height of the collar may be used in any of the disclosed embodiments herein.

In this arrangement, the attachment of the collar forming the wall of the outer tubular member may be made by e.g. circumferential welds. The collar in this arrangement or in any other embodiment in this disclosure may, or may not, comprise friction increasing means, such as for example grooves, ribs, coating, and/or protrusions, for increasing the holding force of the clamping arrangement. Such friction increasing means may improve the fixing of the first and second members and prevent relative movement between the members.

Thus the present invention provides a system whereby the clamping member is present in the wall of the first member (e.g. outer tubular). The locking member(s) can therefore be associated with a framework affixed to the outer member and can act on the clamping member in order to drive its movement towards an inner member or in order to prevent its movement away from an inner member once the clamping member has been moved into a clamping configuration.

Although the focus of the present invention is on the locking mechanism to maintain a clamping force on an inner (second) member, in many arrangements there is also provided a thrust rod. This transmits the force applied from a pressure inducing member, typically a hydraulic piston that is positionable by e.g. a ROV or a diver, to the inner (second) member, optionally via the clamping member.

Thus, there is provided a thrust rod, said thrust rod being accessible from outside of said first member. Preferably the thrust rod is associated with the clamping member in order to be able to transmit force to the clamping member.

In another arrangement of the system of the present invention, it is possible that no separate clamping member in the form of a pad, nor optionally any collar, is used. In this case both the Thrust Rod (where used) and the at least one locking member (e.g. Locking Pin(s)) penetrate the first member (e.g. outer tubular) through prepared holes in the wall of the first member and be in contact directly with the second member (inner tube) without the use of either a collar or a pad. It is recognised that the capacity of such an arrangement would likely be considerably less than pad, and optional collar, arrangement, but there can be an application suitable for lightly loaded connections.

Thus, the present invention provides a system for clamping a first member and second member together, said system comprising an inner second member and an outer first member, said inner second member being concentrically aligned within said outer first member, said outer first member having in moveable association with it at least one clamping and/or locking member wherein said at least one clamping and/or locking member is moveable towards the inner second member to contact the inner second member to clamp said first and second members together;

wherein said at least one clamping and/or locking member comprises means preventing it from passively moving away from the second member in order to prevent loss of the clamping force on the second member.

Preferably the means is a threaded portion on the clamping and/or locking member.

As discussed above, at least pair of locking members is efficient.

Therefore there is provided a system wherein said at least one clamping and/or locking member comprises at least two clamping and/or locking members.

Preferably said at least two clamping and/or locking members are positioned in substantially the same plane on the first member.

It should be noted that the various features described herein in relation to a system comprising a separate clamping member and locking member can be equally applicable to the system where there is no distinct clamping member and where the locking members can act directly on a second member (inner tubular).

There is also provided a tool to deliver a clamping load to a clamping member, said tool comprising a pressure inducing member (e.g. hydraulic cylinder) which in use exerts a force transmissible to said clamping member, said tool further comprising equipment used for its function housed within a protective framework or compartment, which protective framework comprises perforated sides in order reduce weight of said tool.

Preferably the protective framework of the tool contains buoyant material in order to reduce apparent weight when submersed.

Throughout this application the term thrust pin and thrust rod are considered interchangeable. Furthermore these Thrust rods/Pins are shown as solid cylinders but could equally be rectangular or square and equally be of a hollow cross section.

In one embodiment of the present invention, there is a substantially (horizontal) radial pair of (optionally threaded) locking pins disposed radially and substantially perpendicular to the longitudinal axes of the concentric inner and outer tubulars so as to intersect along the longitudinal axis of the thrust pin. The locking pins can optionally be housed within and/or aligned using tubular sleeves. These members provide a direct means of load transfer between the outer tubular and the reaction plate. This load transfer capacity may be reinforced using stiffener plates.

In another embodiment of the invention, there may be one (e.g. a single) or more, optionally threaded, locking pins disposed substantially perpendicular to the longitudinal axes of the concentric inner and outer tubulars. In some aspects, the one or more locking pins may be offset to the longitudinal axis of the thrust pin. In some aspects, the locking pin(s) are not housed within a tubular sleeve. In other aspects, the locking pin(s) may be housed within a tubular sleeve. In any of the aspects, there may be the optional use of stiffeners to provide a reactive load path between the outer tubular and the reaction plate. This load transfer capacity may be reinforced using a tubular sleeve.

In addition or alternatively, another embodiment discloses an arrangement with a pair of threaded locking pins set substantially perpendicular to the longitudinal axes of the concentric inner and outer tubulars and offset either side of a substantially centrally located thrust pin and/or cylinder release pin. The locking pins may optionally be housed within a tubular sleeve. Optional longitudinal and/or transverse stiffeners provide reinforcement to the tubular sleeve and a reactive load path between the outer tubular and the reaction plate. The load transfer capacity is substantial and may be reduced as required by removal of either the longitudinal and vertical stiffeners or the tubular sleeves.

The tool of the present invention may be introduced vertically or sideways between the locking pins, depending on the location of the locking pins.

Another embodiment shows an arrangement with a single threaded locking pin set substantially perpendicular to the longitudinal axes of the concentric inner and outer tubulars and substantially centrally between e.g. two thrust pins and cylinder release pins.

There is also disclosed a threaded collared boss to improve serviceability of the connector by allowing introduction of e.g. Corrosion Resistant Alloy (CRA) threaded elements.

A further embodiment of the invention shows use of a spring or multiple springs set within the hydraulic cylinder assembly for returning the piston to the original retracted position.

It should be noted that the following description of "embodiments" of the invention are not mutually exclusive, and are not necessarily to be considered as self-contained embodiments. Specific features of the invention as described in one or more embodiments of the invention may be combined with other features of the invention described in different embodiments.

The connection between the two tubulars is via deformation of the inner tubular is created by exerting a heavy clamping force using a pressurised hydraulic cylinder, or similar, to apply a clamping load to the inner tubular against the collar via a sympathetically shaped pad. This will deform the circular section inner tubular into a slightly ovalised shape. Such deformation may be limited so that the deformation is largely within the elastic property range of the inner tubular. Once deformed this deformation and thereby the clamping reactive force may be maintained using a locking arrangement in the form of threaded locking pins. The quantity and orientation of the locking pins may vary to suit construction methods. Arrangements one or more locking pins may be utilised with the pin(s) arranged perpendicular or inclined to the longitudinal axes of the tubulars and may be set radially or orthogonal with respect to the plane of the connected tubulars.

The locking arrangement utilises at least one threaded Locking Pin to maintain the deformation in the Inner Tubular. The threaded Locking Pin is located in a threaded hole set in a Reaction Plate tied to the outer Tubular via a framework. One end of the Locking Pin is contactable with the outside of the Pad. The other ends of the Locking Pin passes through the Reaction Plate and is accessible from outside of the Reaction Plate allowing external engagement of the Locking Pin and thereby permitting rotation and subsequent axial movement of the threaded Locking Pin relative to both the Reaction Plate and the Pad. This axial movement allows any gap between the end of the Locking Pin and the Pad to be either closed or opened following deformation of the Inner Tubular. Following closure of this gap the hydraulic cylinder may be depressurised and removed. Typically this would allow the Inner Tube to return to the original circular shape but the Locking Pin prevents this. By maintaining this deformation the heavy clamping force is largely maintained and thereby the clamp remains engaged or 'locked'. It should be recognised that the gap is created by a combination of both deformation of the inner tubular and also the outer tubular and associated framework.

Optionally a threaded block is attached to the Reaction Plate. Again the Locking Pin is accessible at the outer end allowing relative axial movement to close or open the gap between the Locking Pin and the back of the Bearing Pad.

Optionally the Locking Pins are aligned radially to the concentric centre of the axes of the connected tubular members, this being an efficient means of maintaining the deformed shape of the inner tubular as it prevents rotation of the pad and subsequent relaxation of the contact forces.

Optionally the Locking Pins are at the same elevation as the applied clamping force (Thrust Rod), this being an efficient means of maintaining the deformed shape of the inner tubular as it prevents rotation of the pad and subsequent relaxation of the contact forces once the initial clamping force is removed.

Optionally the Locking Pins are fully threaded and encased in a solid threaded section, this this being an efficient means of maintaining the deformed shape of the inner tubular by minimising the relaxing strain in the Locking Pin due to its continual threaded engagement along its full length.

Optionally the exposed ends of the Locking pins may have a suitably shaped (square or hexagonal) opening or projection to allow docking of a removable operator or handle suitable for diver or ROV use.

Optionally, adjacent to the external end of the Locking Pin a graduated marker or scale may be fixed to the Reaction Pad to allow visual reference to the amount of axial movement of each Locking Pin.

Optionally, a heavy load distribution pad may be introduced at the back of the Bearing Pad used to improve dispersion of the loads and reduce localised plastic deformation of both pad and pile. This reduces the losses in the system when load is transferred to the Locking Pin.

Optionally, the Collar Hole has a close fitting Pad that permits forward and reverse travel only for the Pad in a direction perpendicular to the axis of the Inner Tubular. To assist the close fitting requirement of the Pad in the Collar Hole an arrangement of Spacer Plates may be used. These Spacer Plates may be fixed to either the external edge of the Pad or the internal edge of the Collar Hole.

There is also described a Tool to deliver the clamping load to the Thrust Rod, which will optionally include an Hydraulic Cylinder. This may bare against a threaded Hydraulic Cylinder Release Pin set within and projecting from the Reaction Pad. On depressurisation of the Cylinder the Release Pin may be rotated to reduce the projection and thereby create a gap that may allow the Tool and attached Hydraulic Cylinder to be easily withdrawn.

The Tool may optionally include hydraulic tubing and equipment housed within a protective framework or compartment.

The hydraulic tubing and equipment may be suspended from the top or side plate and may be preassembled with full access prior to being attached to the remainder of the protective compartment. This allows ready removal and maintenance of the hydraulic components.

Optionally, the Hydraulic cylinder may be suspended in a protective shroud at the bottom of the Tool.

Optionally, the protective compartment is able to contain buoyant material in rigid preformed units in a shape sympathetic to the shape of the compartment or in loose form. The loose form material may be in the form of minispheres or microspheres or cubes or other pre-formed geometric shape that are compatible to allow efficient packing within the compartment and between the hydraulic components and tubing.

Optionally, the Protective compartment may have perforated sides in order to allow free drainage of the compartment and also allow cleaning of the buoyant material.

Optionally, the valve stem or other fragile components within the valve may be protected from over torquing and damage by permitting only rotation in the opening direction. This will protect the valve stem from damage. The single direction rotation will be ensured by slipping a circular teethed ratchet plate over the valve handle and setting a pawl to prevent inadvertent rotation in the closing direction.

Optionally, the external shape of the Tool Compartment shall assist entry or docking of the Tool into the Tool Receptacle within the Connector Frame.

Optionally, the sloping interface between the piston and Thrust pin. This is either a sloping machined face or a cap plate that can be fixed to the piston or Thrust pin to create a sloping interface. The sloping interface arranged to allow a gap to develop the instance the RRU is lifted.

Optionally, the radial pair of aligned locking pins set at the same elevation as the Thrust Pin. This is aligned with the Thrust Pin to minimise losses on depressurisation. This is because there is no appreciable rotation of the pile on depressurisation.

Optionally, the use of a sleeve or sleeves to protect the locking pin and provide a maintainable annulus to contain preservative fluid or grease to prevent or minimise corrosion.

Optionally, the use of a threaded boss and or threaded Locking Pin in a CRA material. This will allow the device to be unlocked and re locked at a later date.

Optionally, the hydraulic cylinder shall incorporate at least one spring contained within a cowling to force the piston into the retracted position when the hydraulic fluid pressure is removed.

DESCRIPTION

An embodiment of the present invention shows a horizontal radial pair of threaded locking pins disposed radially and substantially perpendicular to the longitudinal axes of the concentric inner and outer tubulars so as to intersect along the longitudinal axis of the thrust pin.

Figure 1:
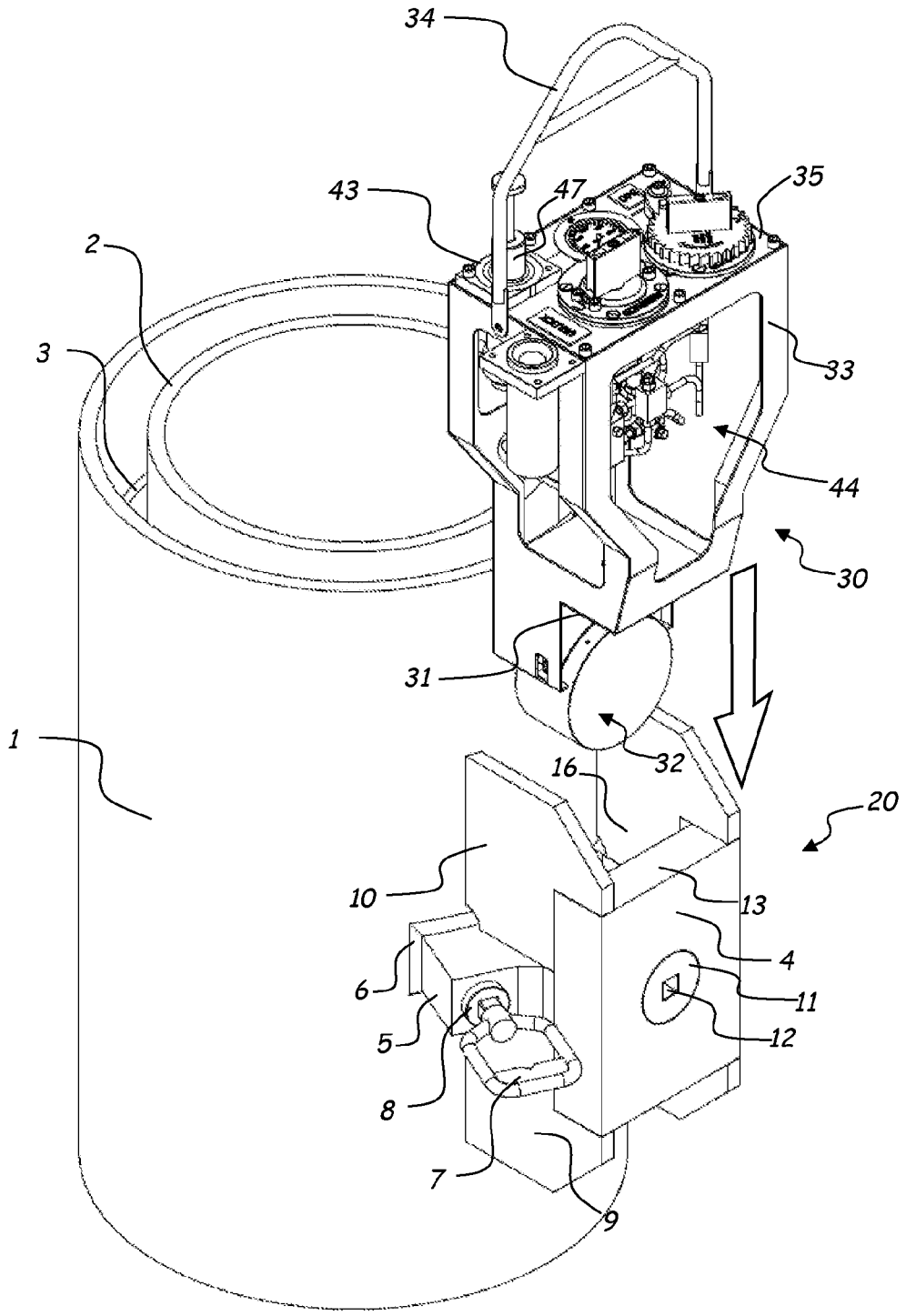
FIG. 1 shows a general arrangement of a first configuration of a tubular clamping arrangement with a second member concentrically placed within a first member, the first member having a connector frame mounted on it.

FIG. 1 shows a second member (an inner tubular (2)) concentrically placed within a first member (the outer tubular (1)). A collar (3) (optional) is attached to the outer tubular (1) to centralise the inner tubular with respect to the outer tubular. A connector frame (20) is mounted on the outer tubular (1). This figure shows the tool (30) positioned above the connector frame receptacle (16) prior to lowering and docking into the connector frame. The tool consists of a hydraulic cylinder (32) (pressure inducing member) suspended from a robust tool frame (33) in which is housed the hydraulic system (44) that receives intermediate pressure hydraulic fluid from the ROV via the hotstab (43). The hydraulic system (44) receives the input hydraulic fluid from the ROV at intermediate pressure and via use of a pressure intensifier generates a high pressure output that it supplies to the hydraulic cylinder (32).

Figure 2:
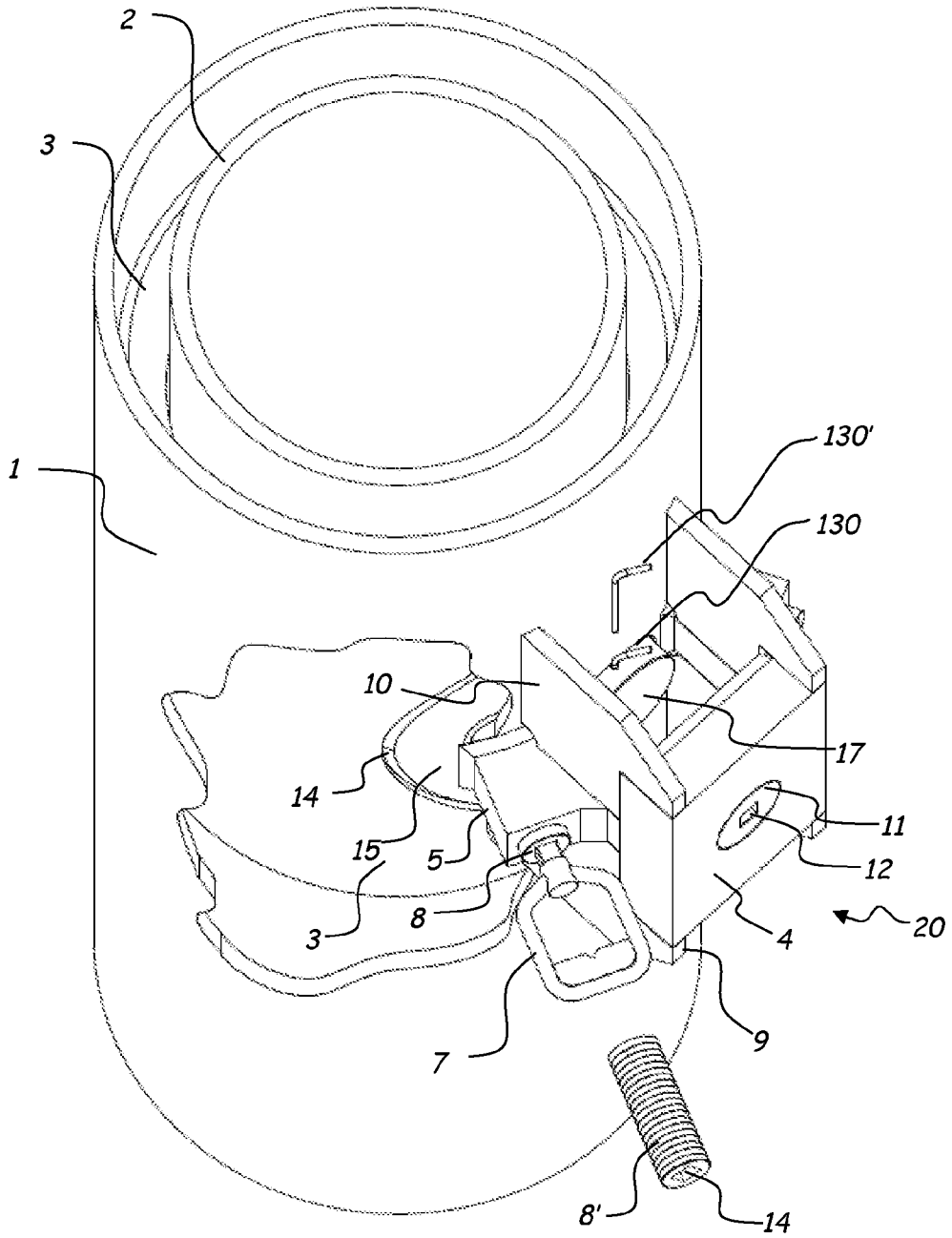
FIG. 2 shows the first member with a section cut away revealing an attached collar.

FIG. 2 shows the outer cylinder (1) with a section cut away revealing the attached collar (3) (where present). The collar (3) has a pad hole (14) into which is set a close fitting clamping member (pad (15)). A connector frame (20) consisting of a vertical reaction plate (4) fixed to the outer tubular (1) optionally via one or more (e.g. a pair of) lower vertical stiffener(s) (9) and one or more (e.g. a pair of) upper vertical stiffener(s) (10) and also optionally via a locking frame (e.g. a locking pin block (5)). A pair of locking members (threaded locking pins (8)) run through the locking pin block (5). The locking member (pin) is also shown in the fully withdrawn position (8'). The locking pins are aligned radially to the axis of the concentric tubular and collar arrangement (1, 2 and 3). Once the tool is docked into position the hydraulic cylinder (32) sits between and aligns with the centre of the thrust rod (17) and the threaded cylinder release pin (11). This threadable pin or pins is/are not a locking member but effectively an adjustable surface of the Reaction Plate against which the pressure inducing member pushes. This provides not only a means to accommodate variable lengths of hydraulic cylinder but is also useful (following removal of the hydraulic fluid pressure) to reduce or relieve the residual load that could otherwise be locked in to the system and assists in allowing recovery of the hydraulic cylinder. This is particularly useful when the spring return feature is not used. When activated the piston (pressure inducing member) in the hydraulic cylinder pushes the thrust rod forward and reacts against the cylinder release pin. The thrust rod is attached to the pad (15) via a recessed bolt (18) and the two are held in position with respect to the outer tubular (1) by the thrust rod retaining pin (130) that runs through a hole (21) passing through the thrust rod. Activation of the hydraulic cylinder (32) drives the thrust rod and pad (15) forward against the inner tubular (2). Prior to pressurising and activating the hydraulic cylinder the thrust rod retaining pin (130) is removed by withdrawal (130') or alternatively the relatively low resistance of the thrust rod retaining pin will be overcome by shear through during activation. Both the locking pins (8) and the cylinder release pin (11) may be operated or rotated by any suitable means. For example, by using a removable square (or hexagonal or similar) section drive grab handle (7). The drive section is stabbed into the complementary (e.g. square (or hexagonal or similar)) socket at the end of either the locking pins and/or cylinder release pins and rotated either clockwise or anti-clockwise to move the respective element inward or outward with respect to the assembly thereby locking or releasing the element. The handle (7) once used may be recovered leaving the profile of the assembly snag free in profile. Alternatively the locking pins or cylinder release pins may have permanently fixed operator handles to eliminate the need to stab the drive sections into the sockets thereby reduce operation time.

Figure 5:
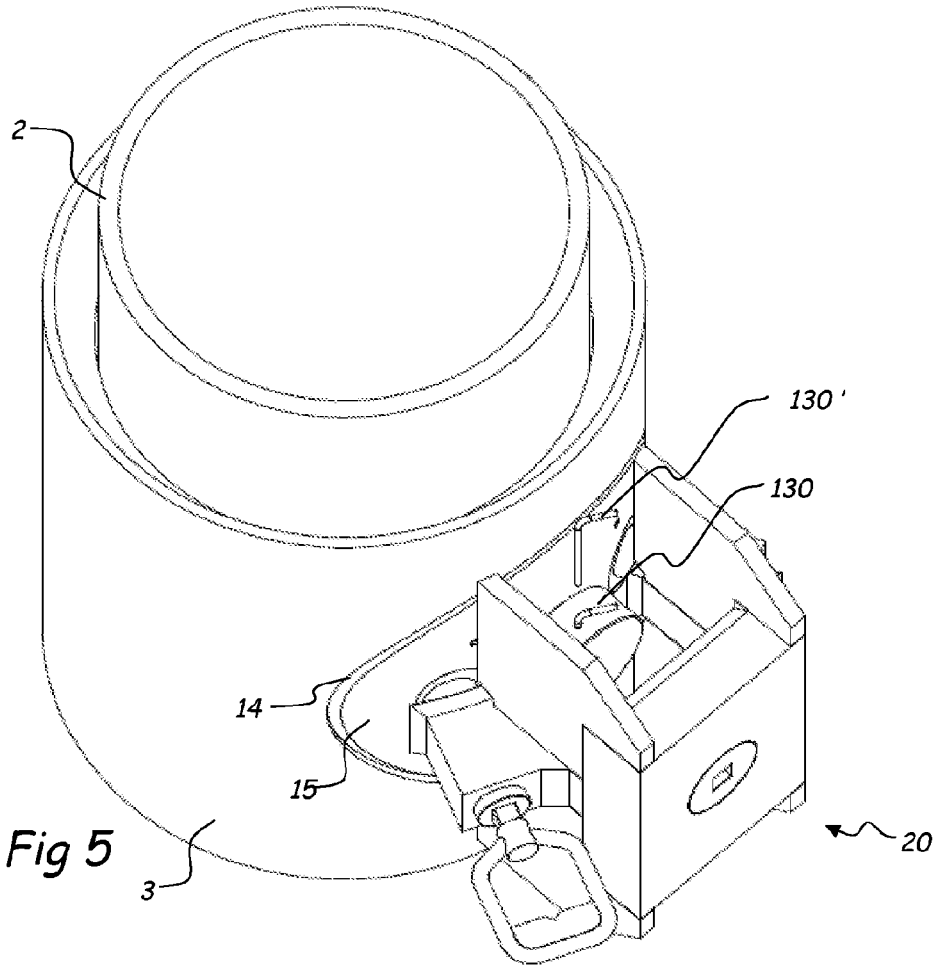
FIG. 5 shows a similar view to FIG. 2 but the first member that is fixed to the collar has not been shown.
Figure 6:
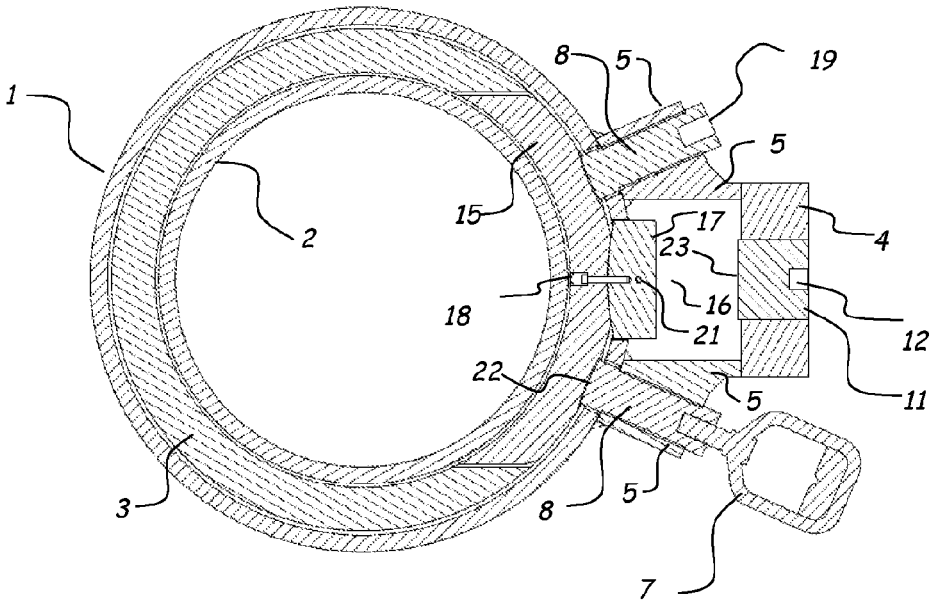
FIG. 6 shows a horizontal cross section of FIG. 5 through the plane of the locking pins and thrust pin, the pad and the hydraulic cylinder release pin.

FIG. 5 shows a similar view to FIG. 2 but the outer tubular (1) that is fixed to the collar (3) for convenience has not been shown. This view exposes the collar (3), the collar hole (14) and the pad (15). FIG. 6 shows a horizontal cross sectional view through the centre of the axis of the thrust rod (17). By driving against the inner tubular (2) against the collar (3) the inner tubular becomes deformed and a gap develops at the interface (22) between the end of the locking pin (8) and the outside face of the pad (15). This clamping of the inner tubular (2) against the collar (3) generates high frictional contact forces that prevent relative movement between the inner and outer tubular. The locking pins (8) may at this stage be rotated to move forward and once again create contact between the inside face of the pad and the locking pins. In doing so this effectively retains the inner tubular (2) in the deformed shape. At this stage the hydraulic cylinder (32) may be depressurised whilst still retaining the clamping action of the connector and therefore the inner tubular and outer tubular are effectively locked together. A reversal of this operation would allow the two tubulars to be unlocked. Once the hydraulic cylinder is depressurised the cylinder will still be in close contact with both the thrust rod (17) and the cylinder release pin (11) although high load would not be transferred. By rotating the threaded cylinder release pin (11) it will be moved away from the hydraulic cylinder creating a gap that would allow the tool (30) to be vertically withdrawn and recovered to the surface.

Figure 3:
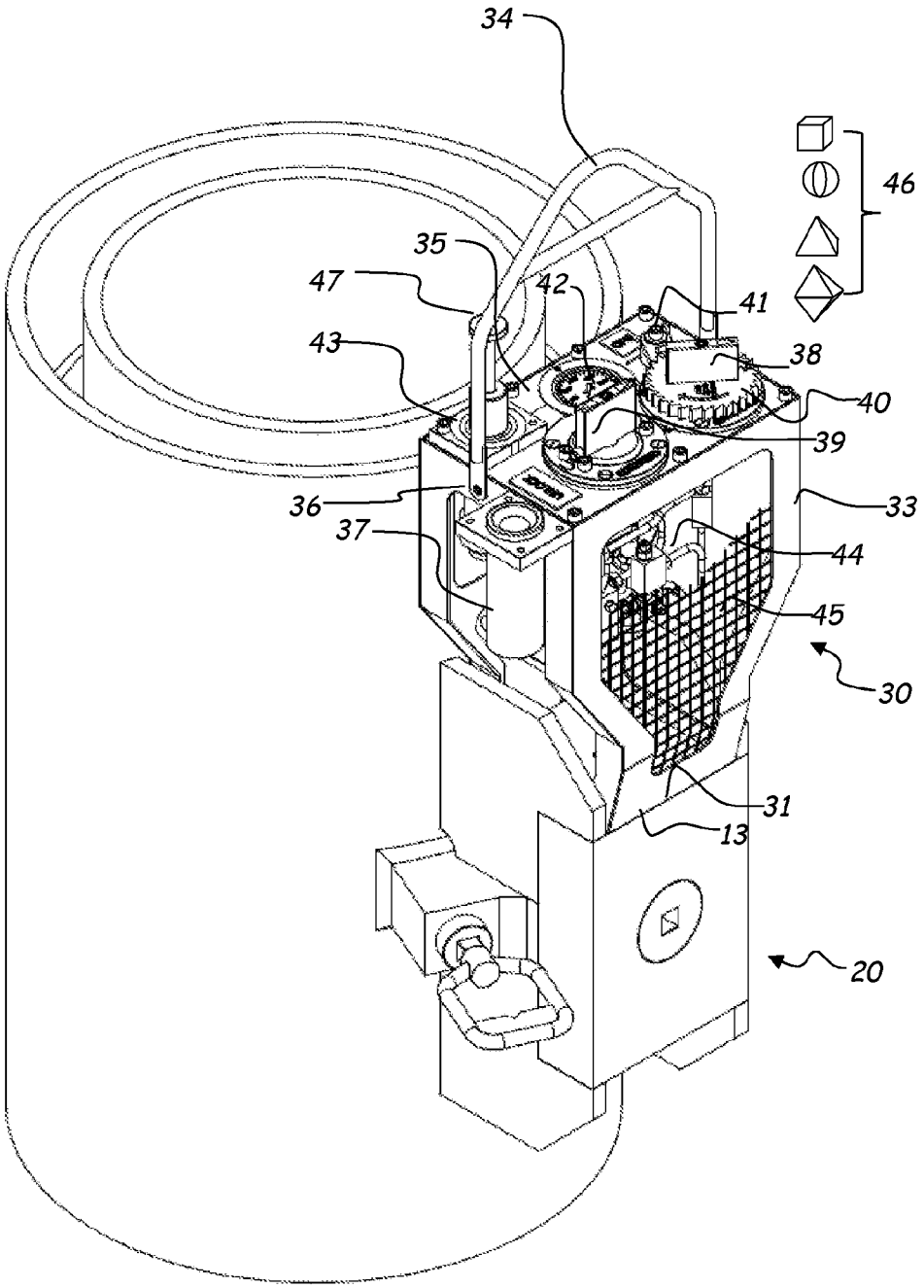
FIGS. 3 and 4 show a tool (comprising a pressure inducing member) docked into a connector frame receptacle formed between the connector frame and the first member.
Figure 4:
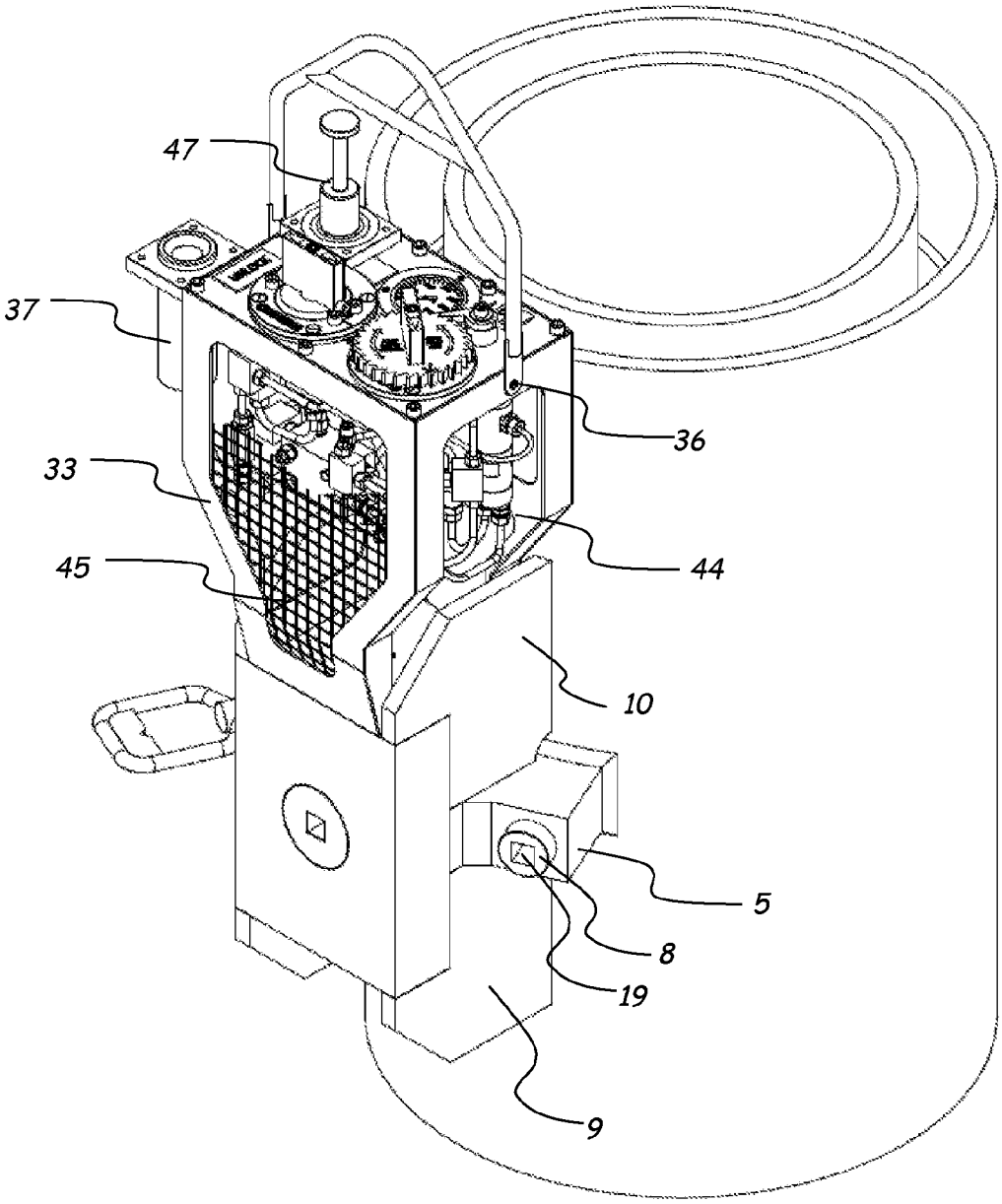

FIGS. 3 and 4 shows the tool docked into the connector frame receptacle (16) with the underside (31) of the tool (30) resting on the upper surface (13) of the reaction plate (4). To minimise tool weight the tool preferably is constructed using a rigid outer frame (33). This frame protects the hydraulic equipment and tubing and also provides an ROV interface plate (35) onto which is mounted the controls. It is appreciated that the interface plate may equally be orientated in the horizontal or the vertical for convenience. The controls include a range of valve operators (38 and 39), a gauge for monitoring of the delivered cylinder pressure (42) and both the hotstab receptacle (43) and the dummy hotstab receptacle (37). To pressurise the cylinder the ROV or diver removes the hotstab dummy (47) and places it into the dummy hotstab receptacle (37). Then the hotstab (not shown) is placed into the receptacle (43) and the supply line activated. To protect the delicate needle valve stem from being overloading by the ROV a ratchet (40) and pawl (41) is used that allows only one way operation.

To reduce tool weight further and increase manoeuvrability of the tool subsea mesh (45) is fixed to the framework (33). This mesh is shown on FIGS. 3 and 4 on the front face of the tool but may also be used on one or more (e.g. two, three, four, all) other sides of the tool. This provides an effective container or box for buoyancy material. The buoyancy material may be in the form of rigid blocks of syntactic foam or similar but for convenience buoyancy material may be supplied in small shaped units. Some examples of these buoyant shapes are indicated (46) but may be in any suitable shape allowing the buoyancy box to be filled in loose form buoyancy shapes. The ideal shape of the buoyancy units would suit the manufacturing process and also allow the irregular space in the box to be filled in a convenient and efficient way. The various shapes will result in a different packing density and the ideal shape and size will be determined by experiment and analysis. The grill (45) not only contains the buoyancy units but also allows free flooding of the tool. This free passage of water through the mesh removes the potential for damaging the box by external hydrostatic pressure and also allows free draining of the box once recovered from the sea.

FIG. 5 shows a similar view to FIG. 2 but with the outer tubular (1) removed revealing the complete collar (3) and a fuller view of the pad (15).

FIG. 6 shows a horizontal cross section through the plane of the locking pins (8) and thrust pin (17), pad (15) and the hydraulic cylinder release pin (11). The view shows the initial position prior to docking of the tool (30) and engagement of the connector. The thrust rod retaining pin (130) is, at this stage, set within the hole (21) passing through the thrust rod. The inner tubular (2) is concentric within the collar (3) and pad (15). The inside face (23) of the threaded cylinder release pin (11) is set slightly forward of the inside face of the reaction plate (4) and the hydraulic cylinder is yet to be positioned within the connector frame receptacle (16).

Figure 7:
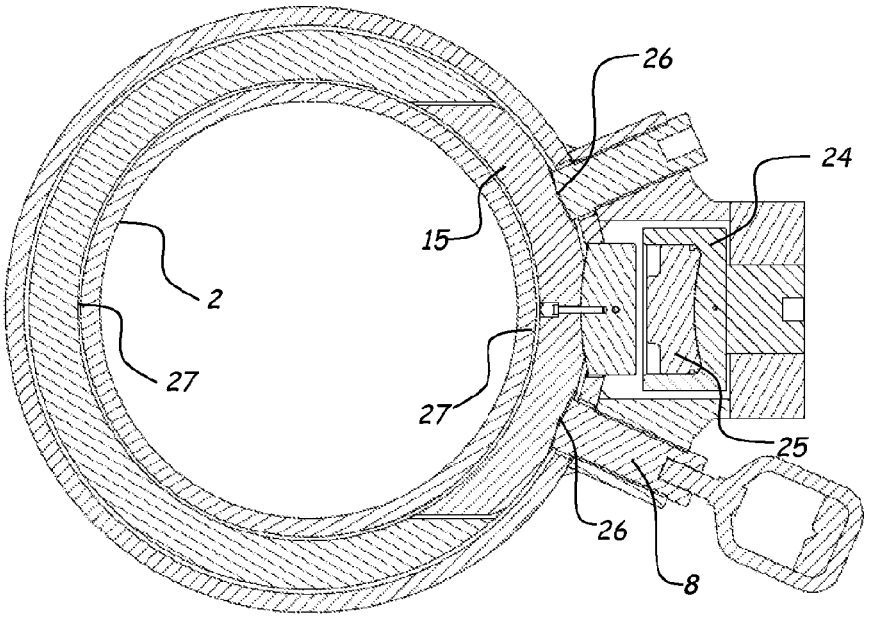
FIG. 7 shows a similar view to FIG. 6 but with the hydraulic cylinder of the tool set within the connector frame receptacle and the back of the hydraulic cylinder body in contact with the inside face of the threaded cylinder release pin.

FIG. 7 shows similar views to FIG. 6 but with the hydraulic cylinder (32) set within the connector frame receptacle (16) and the back of the hydraulic cylinder body (24) in contact with the inside face (23) of the threaded cylinder release pin. The piston (25) is in the retracted position within the hydraulic cylinder body (24). The front face of the locking pins (8) are in positive contact with the outside face of the pad (15). These contact faces (26) may be concave/convex to accommodate misalignment due to orientation and inclination of the pad (15) with respect to the inner tubular (2). There is an annular gap (27) between the inside face of the pad (15) and the outside face of the inner tubular (2).

Figure 8:
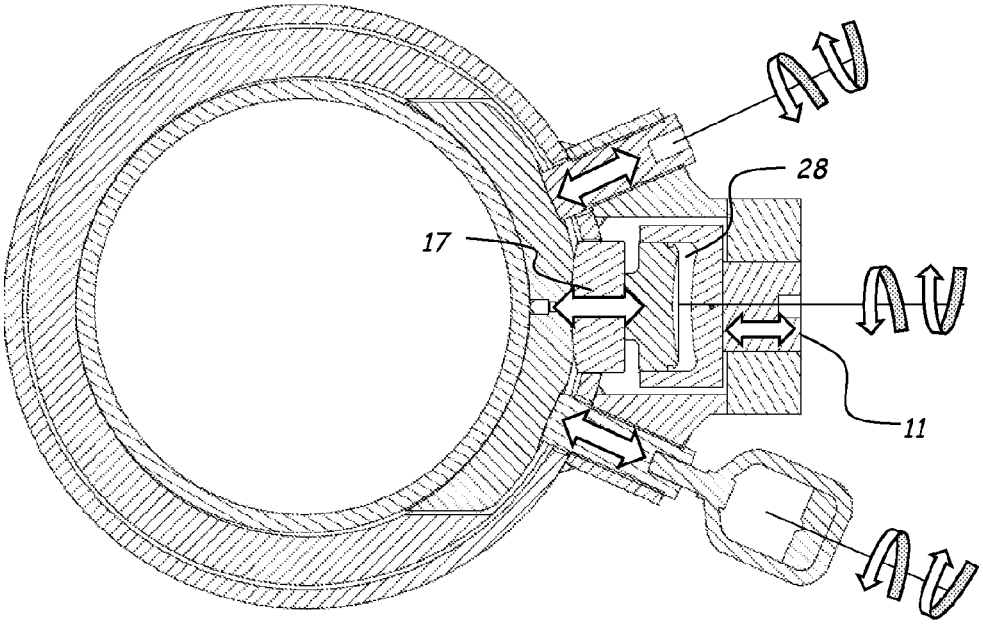
FIG. 8 shows a similar view to FIG. 7 but with the hydraulic cylinder of the tool pressurized and the piston moved forward against the thrust rod that in turn forces the pad against the second member.

FIG. 8 shows similar views to FIG. 7 but with the hydraulic cylinder (32) pressurised and the piston (25) moved forward against the thrust rod (17) that in turn forces the pad (15) against the inner tubular (2). The annular gap (27) is closed along the axis of the piston (25) and there is high pressure contact between the inside face of the pad (15) and the outside face of the inner tubular (2) and also the inside face of the collar (3) and the outside face of the inner tubular. This high pressure will deform the inner tubular (2) into a slightly non circular form and to a lesser extent deform the rest of the assembly. Whilst the piston pressure is maintained the threaded locking pins (8) are rotated to once again be in positive contact at the interfaces (26). With the positive contact maintained at the interfaces (26) the hydraulic fluid pressure in the compartment (28) may then be released and the relative deformations will be largely maintained via the locking pins (8). at this stage the tool (30) may be withdrawn. To assist easy withdrawal of the tool (30) the threaded hydraulic release pin (11) may be rotated to open up a gap between the back of the hydraulic cylinder and the inside face (23) of the hydraulic release pin.

Alternatively, or in addition to the arrangement described above, there is provided an arrangement similar to the first with a radial pair of threaded locking pins disposed radially and substantially perpendicular to the longitudinal axes of the concentric inner and outer tubulars so as to intersect along the longitudinal axis of the thrust pin. In this arrangement the locking pins are aligned using tubular sleeves. These members provide a direct means of load transfer between the outer tubular and the reaction plate. This load transfer capacity may be reinforced using stiffener plates.

Figure 9:
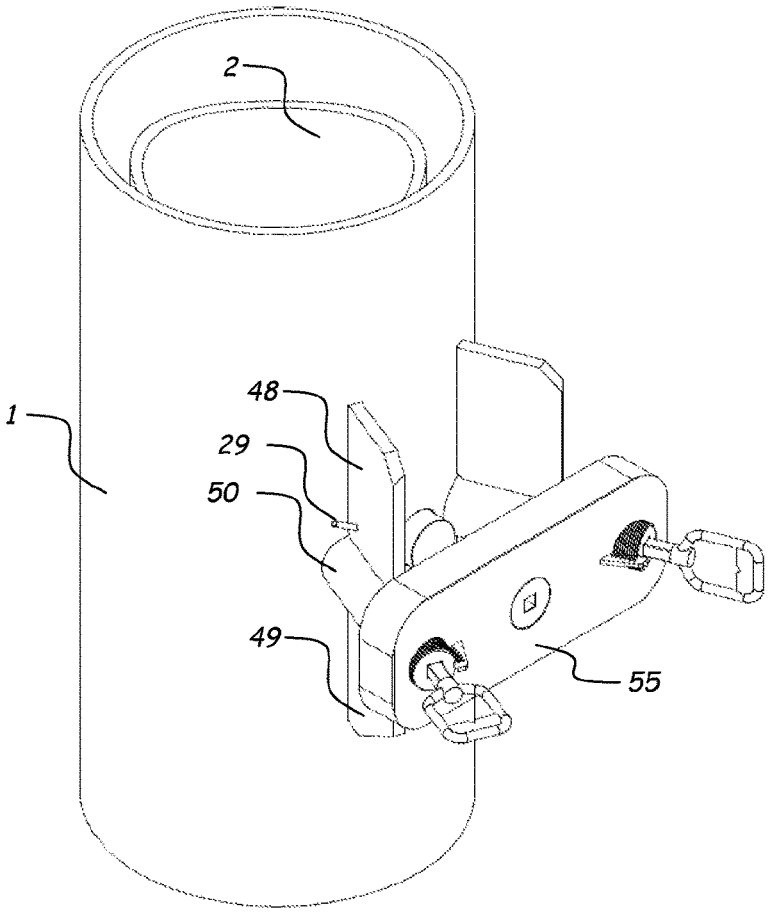
FIG. 9 shows an alternative clamping arrangement with a connector frame mounted on the first member.

FIG. 9 shows the modified connector frame mounted on the outer tubular (1). The tool (30) is not shown but may be similar to the first embodiment.

Figure 10:
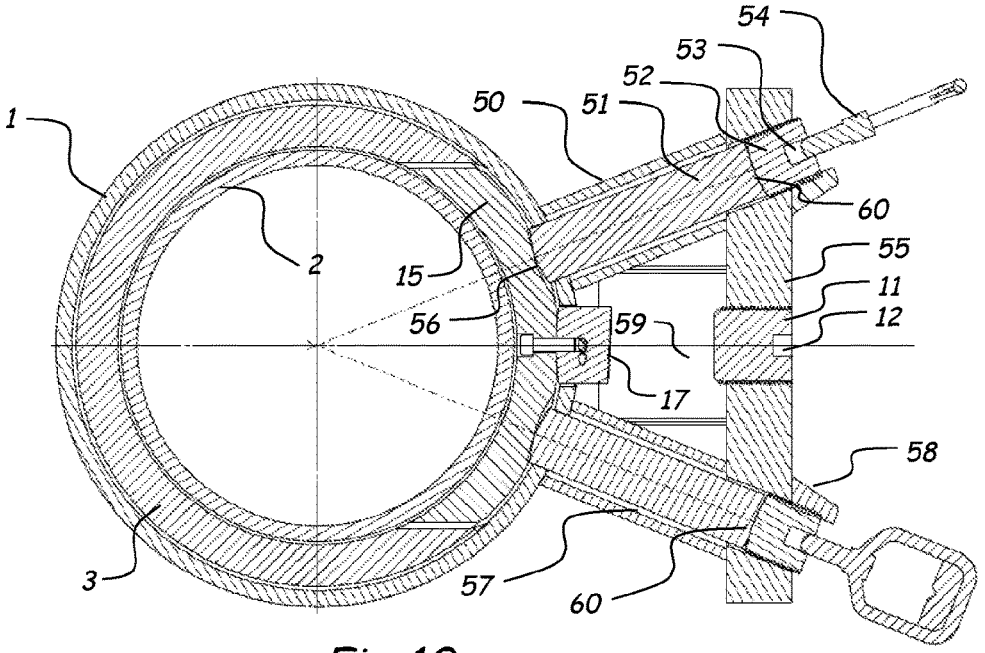
FIG. 10 shows a cross section of the clamping arrangement in FIG. 9 through the plane of the locking pins and thrust pin.

FIG. 10 shows a cross section through the plane of the locking pins (51) and thrust pin (17). The arrangement shows a wider reaction plate (55) spanning between tubular sleeves (50) so as to provide direct load transfer from reaction plate (55) to outer tubular (1). The tubular sleeves (50) also provide protection to the locking pins (51) and may be reinforced by the top and bottom stiffener plates (48 and 49) respectively. The void (57) between the locking pin (51) and the tubular sleeves may be filled with preservative or lubricant to maintain function and minimise corrosion of the locking pin (51). A section of the locking pin (52) is threaded to engage with a corresponding thread on the inside face of the hole through the reaction plate.

To allow for misalignment and avoid damage to the threaded section of the locking pin (52) the locking pin may be cut and a concave/convex bearing face (60) introduced to allow the locking pin to articulate. It will be appreciated that this feature can be present in any of the arrangements described herein.

As with the first embodiment the handles (54) will provide means to rotate and advance/retract the locking pin. The threaded section (52) of the locking pin may have a socket hole (53) to receive the end of handle (54). The handle for the locking pin and the hydraulic cylinder release pin (11) may be common to allow interchangeability of the handles with either the locking pin and hydraulic cylinder release sockets (53 and 12) respectively.

Mounted on the external face of the reaction plate (55) a graduated scale (58) may be fixed to allow the relative movement of the locking pin with respect to the reaction plate to be monitored and recorded. This feature can be present in any of the arrangements described herein, irrespective of the specific arrangement of the locking members themselves.

The locking pin to pad (15) contact faces (56) may also be concave/convex to allow small amount of rotation to accommodate misalignment of the locking pin. An alternative arrangement may utilise a threaded connection along the full length of the locking pin and tubular sleeve (50).

FIG. 10 shows a half shell receptacle (59) suitable for support of the hydraulic cylinder. Such a feature can be present in any of the arrangements described herein.

An inclined thrust rod retaining pin (29) is shown running through the thrust rod (17). Such an arrangement can be present in any of the arrangements described herein.

Prior to activating the hydraulic cylinder the thrust rod retaining pin (29) is removed by withdrawal or alternatively the relatively low resistance of the thrust rod retaining pin will be overcome by shear through during activation.

There is also provided an arrangement with a single threaded locking pin disposed substantially perpendicular to the longitudinal axes of the concentric inner and outer tubulars and offset to the longitudinal axis of the thrust pin. In this arrangement the locking pin need not, but can be, housed within a tubular sleeve. Stiffeners provide a reactive load path between the outer tubular and the reaction plate. This load transfer capacity may be reinforced using a tubular sleeve similar to the second embodiment.

Figure 11:
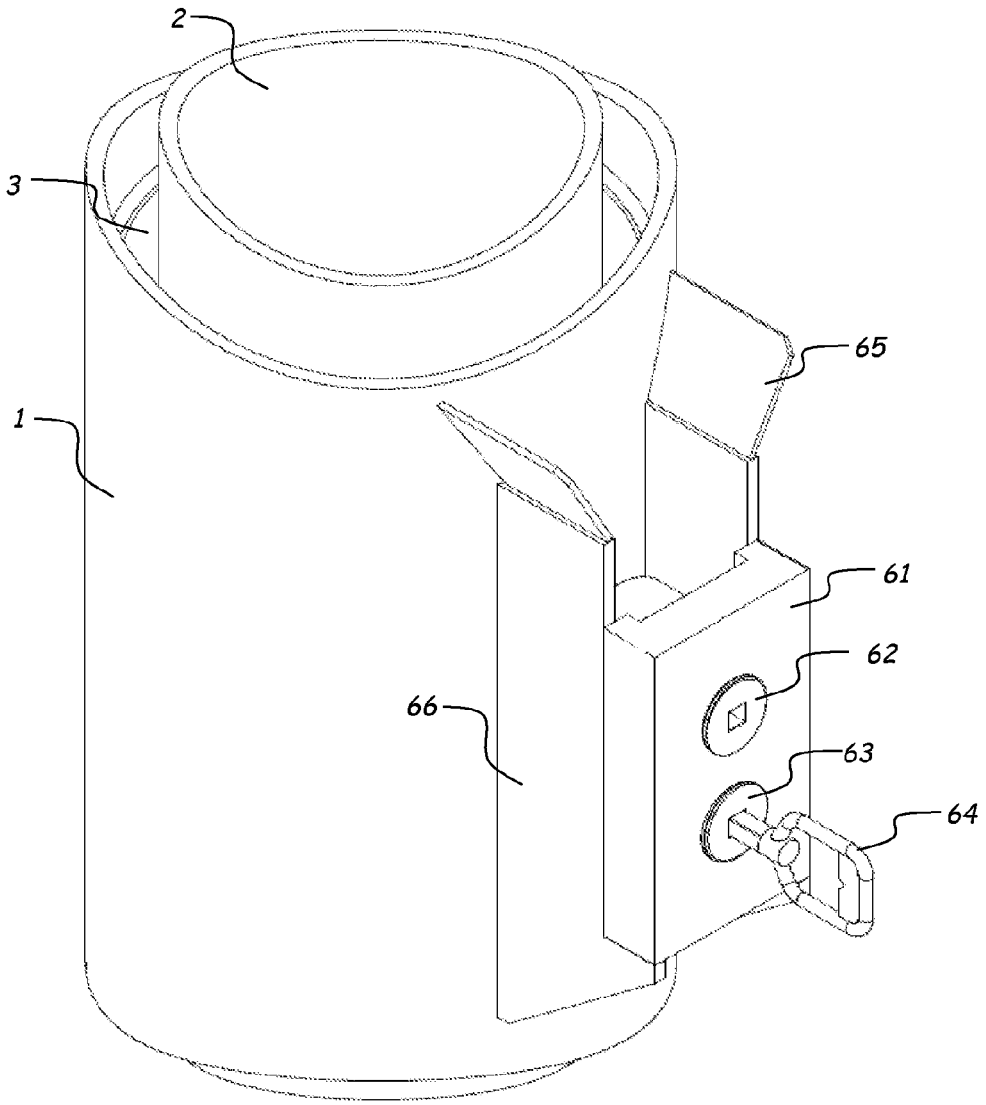
FIG. 11 shows an alternative clamping arrangement with a connector frame having a single locking pin offset from a hydraulic cylinder release pin and stiffeners attaching the reaction plate to the first member.

FIG. 11 shows the single locking pin (63) offset from the hydraulic cylinder release pin (62) and the stiffeners (66) attaching the reaction plate (61) to the outer tubular (1). The tool (30) is not shown but may be similar to that already described.

There are inclined guide plates (65) to assist docking of the tool (30—not shown) onto the reaction plate (61). Such guide plates may be present in any of the arrangements described herein. The arrangement shows a the reaction plate (61) spanning between stiffeners (66).

Figure 12:
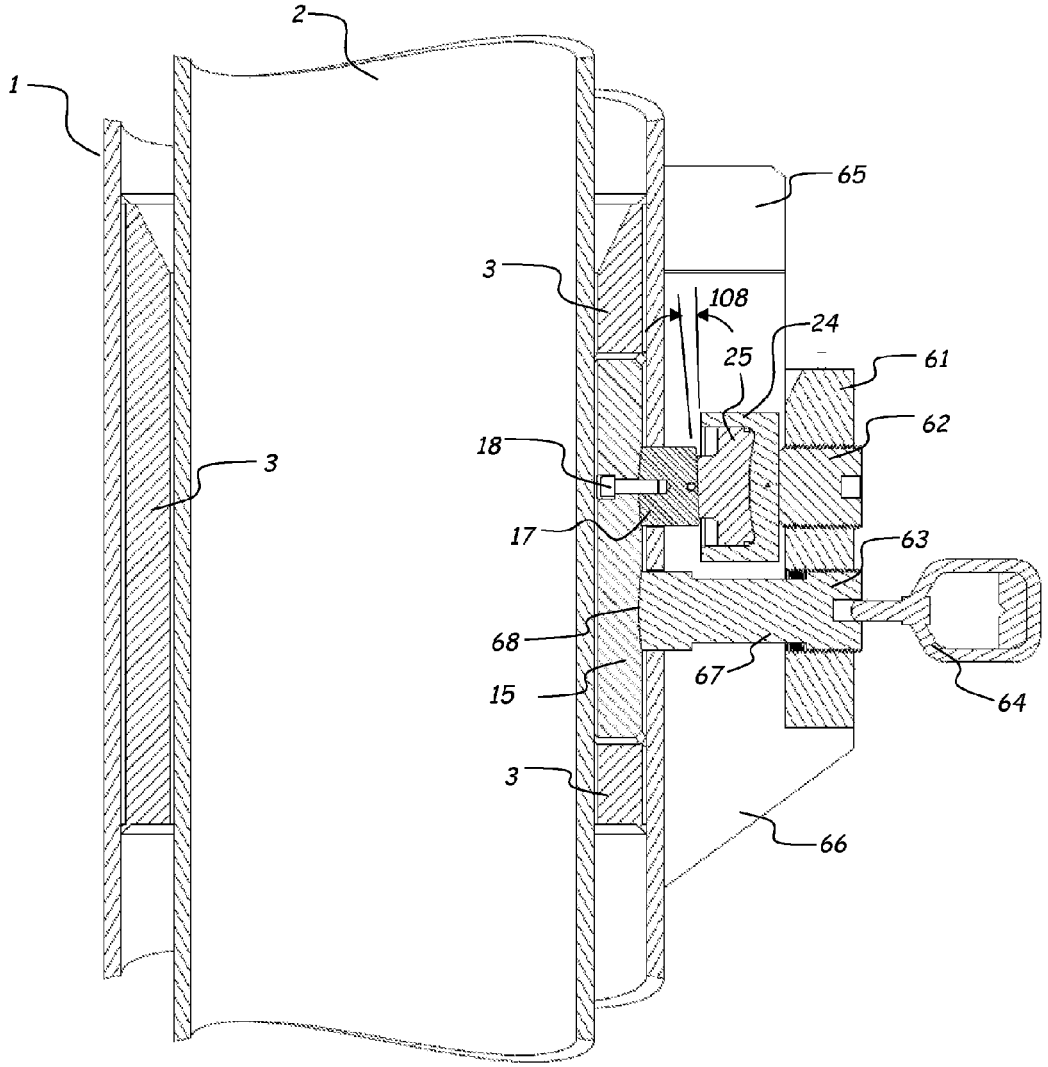
FIG. 12 shows a cross section of the clamping arrangement in FIG. 11 through the plane of the locking pin and thrust pin along the longitudinal axes of the first member and second member.

FIG. 12 shows a cross section through the plane of the locking pin (67) and thrust pin (17) along the longitudinal axes of the outer tubular (1) and inner tubular (2). The hydraulic cylinder (32) only is shown between the thrust rod (17) and hydraulic cylinder release pin (62) whereas the remainder of the tool (30) is not shown. The hydraulic cylinder body (24) and associated piston (25) is aligned axially with thrust rod (17) and the hydraulic cylinder release pin (62). The locking pin (67) has a threaded section (63) that engages with the threaded hole in the reaction plate (61). When high pressure fluid is introduced at the back of the piston (25) the piston (25) advances towards the thrust rod (17) and on contact will, in turn, force the pad (15) and the inner tubular (2) against the collar (3) causing clamping action of the inner tubular within the collar (3).

In this embodiment the contact face of the piston (25) and the thrust rod (17) is inclined at a small angle (108) to assist with the removal of the hydraulic cylinder body (24) following depressurisation. Such an arrangement may also be present in any of the arrangements described herein.

Application of the clamping load described above causes the inner tubular to deform into an ovalised shape in cross section. At this stage the locking pin (67) whose end penetrates the outer tubular may be advanced axially by rotation using the handle (64) to cause the end of the locking pin to contact the outer face of the pad (15) at a concave/convex bearing surface (68). By this contact the locking pin (67) is able then to retain the deformed shape of the inner tubular (2) whilst the hydraulic pressure at the back of the piston (25) is released. By retaining this deformation the reactive contact between the inner tubular (2) and the collar (3) and also the pad (15) and the inner tubular (2) is maintained thereby rendering the inner tubular (2) and the outer tubular (1) fixed in relative position by virtue of the friction developed between the contacting elements.

Alternatively, or in addition to any of the arrangements described herein, there is provided an arrangement with a pair of threaded locking pins set perpendicular to the longitudinal axes of the concentric inner and outer tubulars and offset either side of a centrally located thrust pin and cylinder release pin. In this arrangement the locking pins are housed within a tubular sleeve. Alternatively, they do not need to be housed within a tubular sleeve. Instead, they can be located within e.g. a threaded block. Longitudinal and transverse stiffeners provide reinforcement to the tubular sleeve and a reactive load path between the outer tubular and the reaction plate. The load transfer capacity, as shown, is substantial and may be reduced as required by removal of either the longitudinal and vertical stiffeners or the tubular sleeves. In this embodiment the tool may be introduced sideways between the locking pins.

Figure 13:
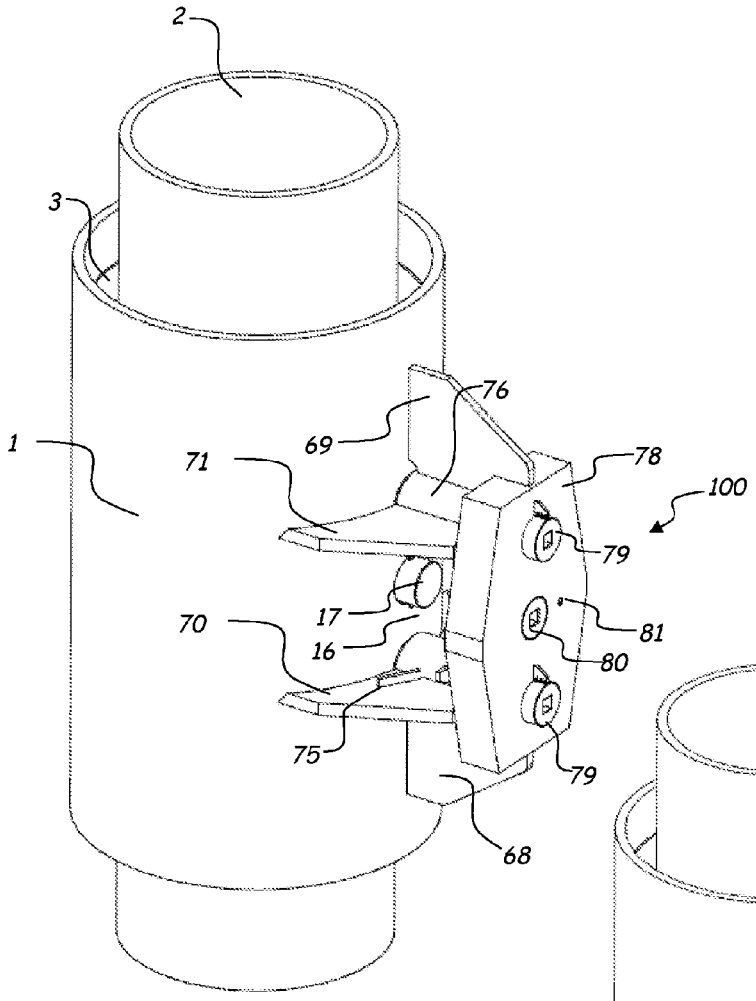
FIG. 13 shows an alternative clamping arrangement with a connector frame with two threaded locking pins offset longitudinally with respect to the thrust rod and the hydraulic release pin.

FIG. 13 shows the two threaded locking pins (79) offset longitudinally with respect to the thrust rod (17) and the hydraulic release pin (80). The tool (90) may be introduced laterally into the tool receptacle (16). The reaction plate (78) is the key element of connector frame (100) which is mounted on the outer tubular (1) via two tubular sleeves (76) plus lower and upper transverse stiffeners (70 and 71) and lower and upper longitudinal stiffeners (68 and 69). A pin hole (81) in the reaction plate (78) is available to receive a tee bar (74) used to locate the tool (90) within the tool receptacle (16). Such a feature may be present in any of the arrangements described herein.

Figure 14:
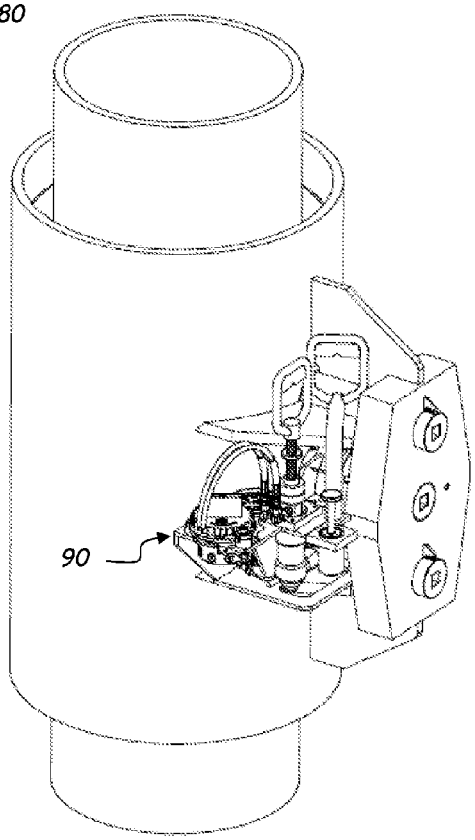
FIG. 14 shows the clamping arrangement of FIG.13 with a tool located in the tool receptacle such that the hydraulic cylinder sits between the inside face of the hydraulic release pin and the bearing face of the thrust pin.

In FIG. 14 the tool (90) is shown located in the tool receptacle (16) such that the hydraulic cylinder (32) sits between the inside face of the hydraulic release pin (80) and the bearing face of the thrust pin (17). The underside of the tool (90) is arranged to rest on the top of the lower transverse stiffener (70) such that the hydraulic cylinder (32) is indexed and aligned with the thrust rod (17) and hydraulic cylinder pin (80). Guide plate (75) are also used to assist with insertion and correct alignment of the tool (90). Such guide plates may also be present in any of the arrangements described herein.

Figure 15:
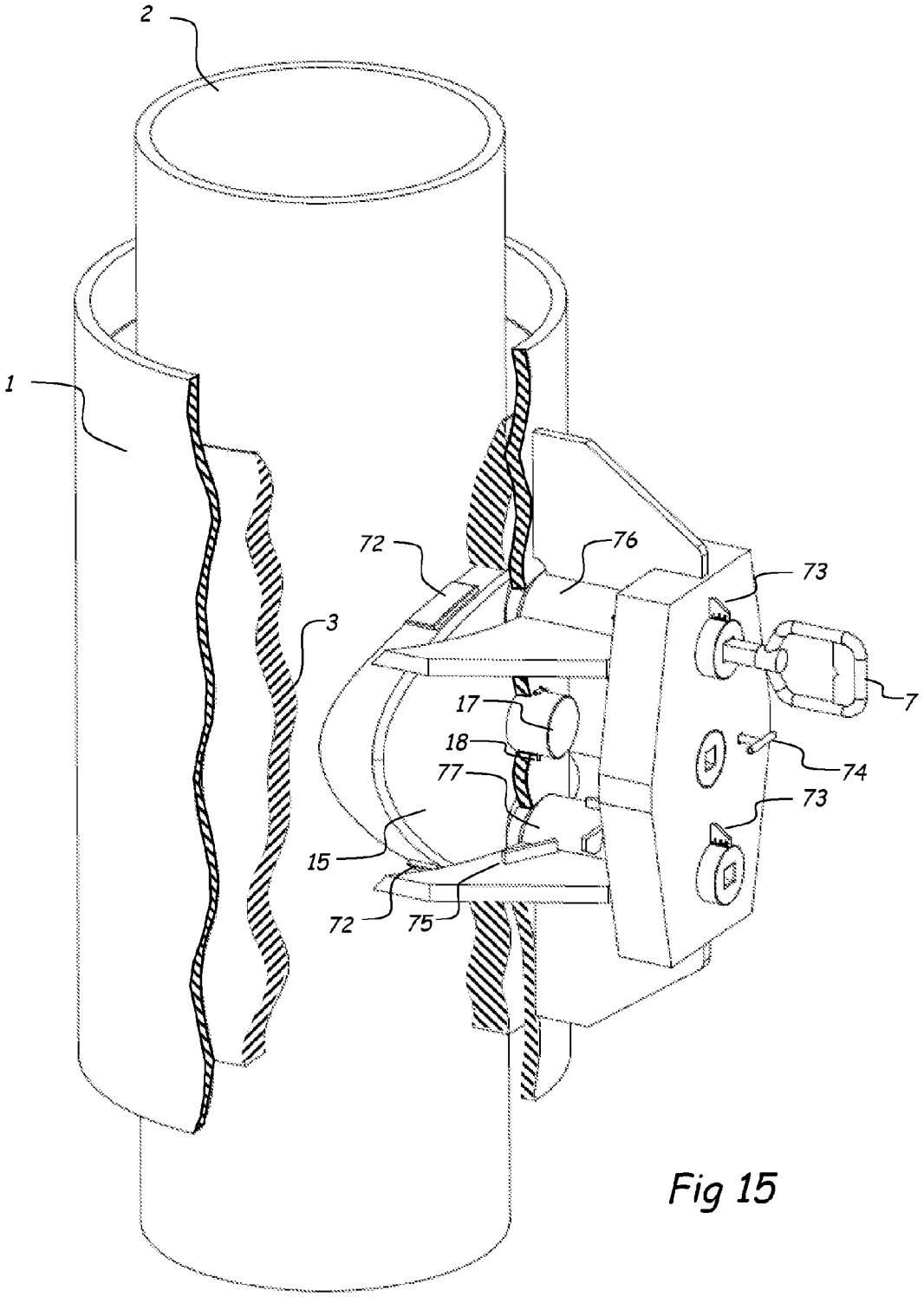
FIG. 15 shows the first member and the collar of the arrangement of FIGS. 13 and 14 partially removed to show the pad.

In FIG. 15 the outer tubular (1) and the collar (3) is shown part removed to show the pad (15). Spacer plates (72) are affixed (e.g. welded) to the side edges of the pad (15) at intervals around the circumference. These will be fitted to suit the gap between the collar hole (14 as shown in FIG. 2) and the pad (15) to ensure a positive contact but allow sufficient clearance to allow free transverse movement of the pad (15) within the collar hole (14). It is important to note that although free movement of the pad towards the longitudinal axis of the inner tubular (2) is essential, it is preferable that the pad does not significantly move either longitudinally or transverse with respect to the hole (14) as this may cause rotation of the pad and incorrect bearing between pad and inner tubular. Although FIG. 15 shows a vertical arrangements of locking members, it will be clear that the spacer plates can be present on the clamping member of any of the arrangements described herein. Alternatively, the spacer plates where present may be affixed to the collar.

Figure 16:
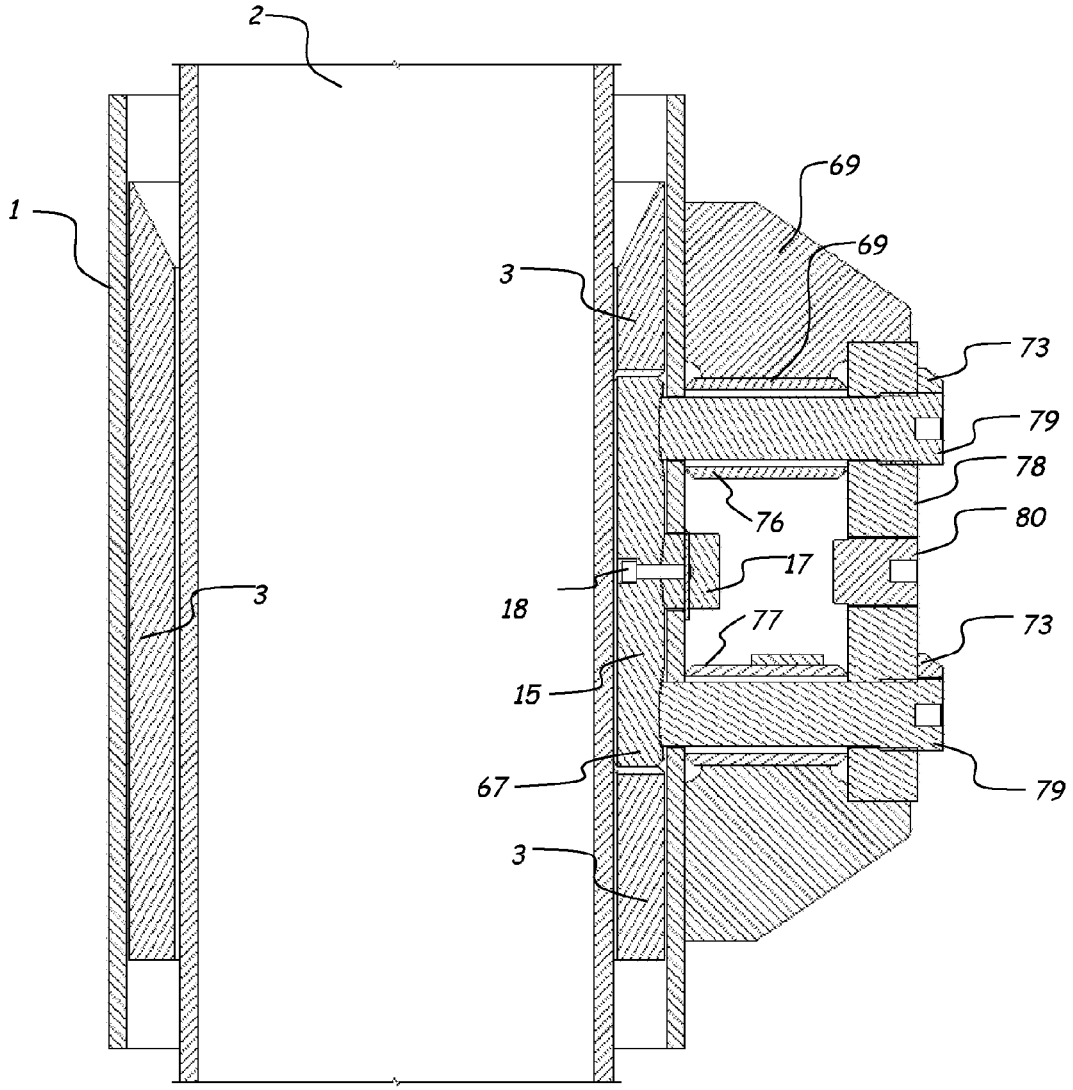
FIG. 16 shows a longitudinal cross section of the clamping arrangement of FIGS. 13-15 through the locking pins, the thrust rod and the hydraulic cylinder release pin.

In FIG. 16 shows a longitudinal cross section of the embodiment through the locking pins, the thrust rod and the hydraulic cylinder release pin (80). This view also shows the upper and lower locking tubular sleeves (76 and 77). The ends of the tubular sleeves are affixed (e.g. welded) to the reaction plate (78) and the outer tubular (1). The weld preparation is shown in this view, following welding the tubular sleeves will have full contact joint with the adjoining elements.

Figure 17:
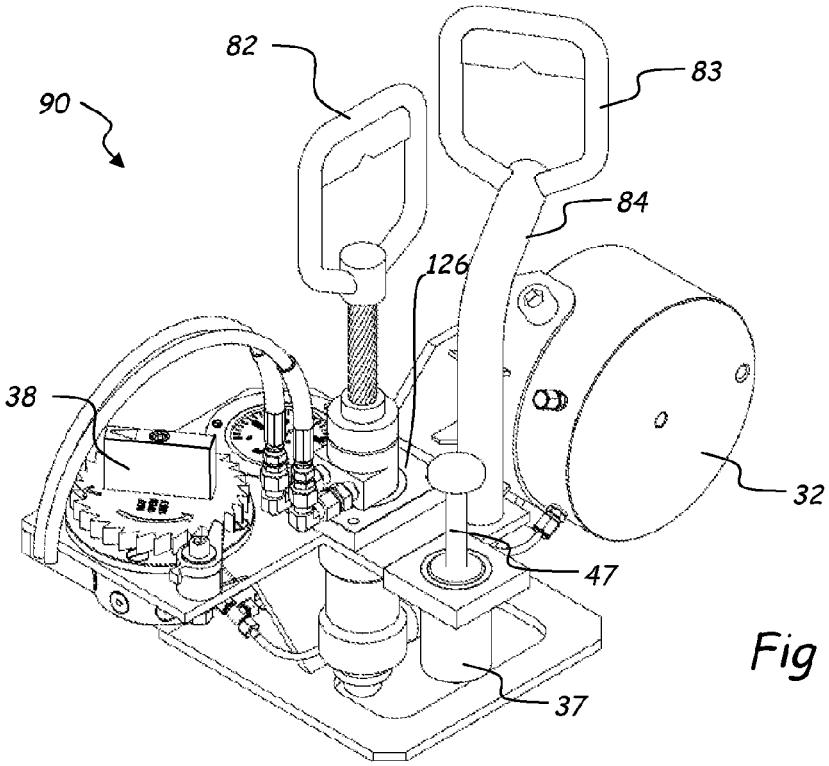
FIGS. 17 and 18 show a tool with a rigid outer frame.
Figure 18:
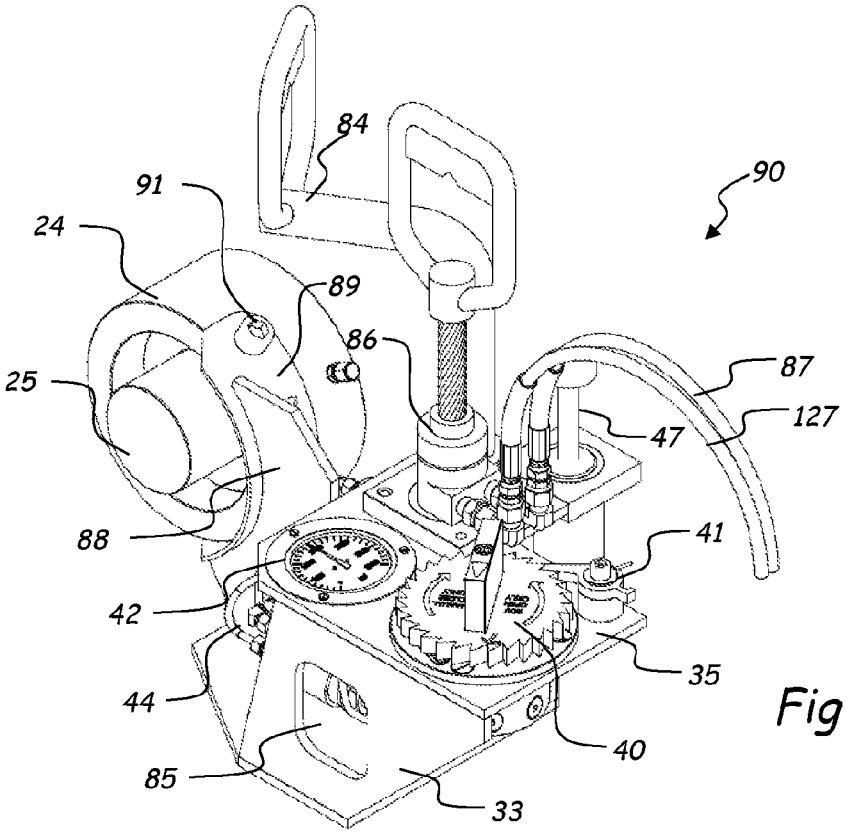

FIGS. 17 and 18 show the tool (90). To minimise tool weight the tool is constructed using a rigid outer frame (33). This frame protects the hydraulic equipment and tubing (44) and also provides an ROV interface plate (35) onto which is mounted the controls. The controls include a range of valve operator (38), a gauge (42) for monitoring of the delivered cylinder pressure and both the hotstab (86) and the dummy hotstab receptacle (37). To pressurise the cylinder the ROV or diver delivers pressurised hydraulic fluid via the supply hose (87) and hotstab (86) into the hotstab receptacle (126). The hydraulic fluid return hose (127) is also shown. The fluid pressure may be increased using an intensifier within the hydraulic assembly and delivers the pressure to the hydraulic cylinder (32) (pressure inducing member) in a cavity between the cylinder body (24) and piston (25), driving the piston forward and causing the clamping action on the inner tubular (2). Following engagement of the locking pins the fluid supply of pressurised fluid is terminated. The hydraulic system (44) may then be depressurised by opening valve (38) allowing fluid pressure to dissipate and allowing fluid to return via the hotstab and the return hose (127). Then the diver or ROV may remove the hotstab (86) by grabbing handle (82) and withdrawing hotstab from the hotstab receptacle (126). The dummy (47) is then recovered from the dummy hotstab receptacle (37) and placed into the hotstab receptacle (126) to prevent entry of seawater and detritus into the hydraulic system (44). To protect the delicate needle valve stem within valve (38) from being overloading by the ROV a ratchet (40) and pawl (41) is used that allows only one way operation—to open.

Alternatively, or in additional to the arrangements described herein, there is provided an arrangement with a single threaded locking pin set substantially perpendicular to the longitudinal axes of the concentric inner and outer tubulars and centrally between two thrust pins and cylinder release pins.

Figure 19:
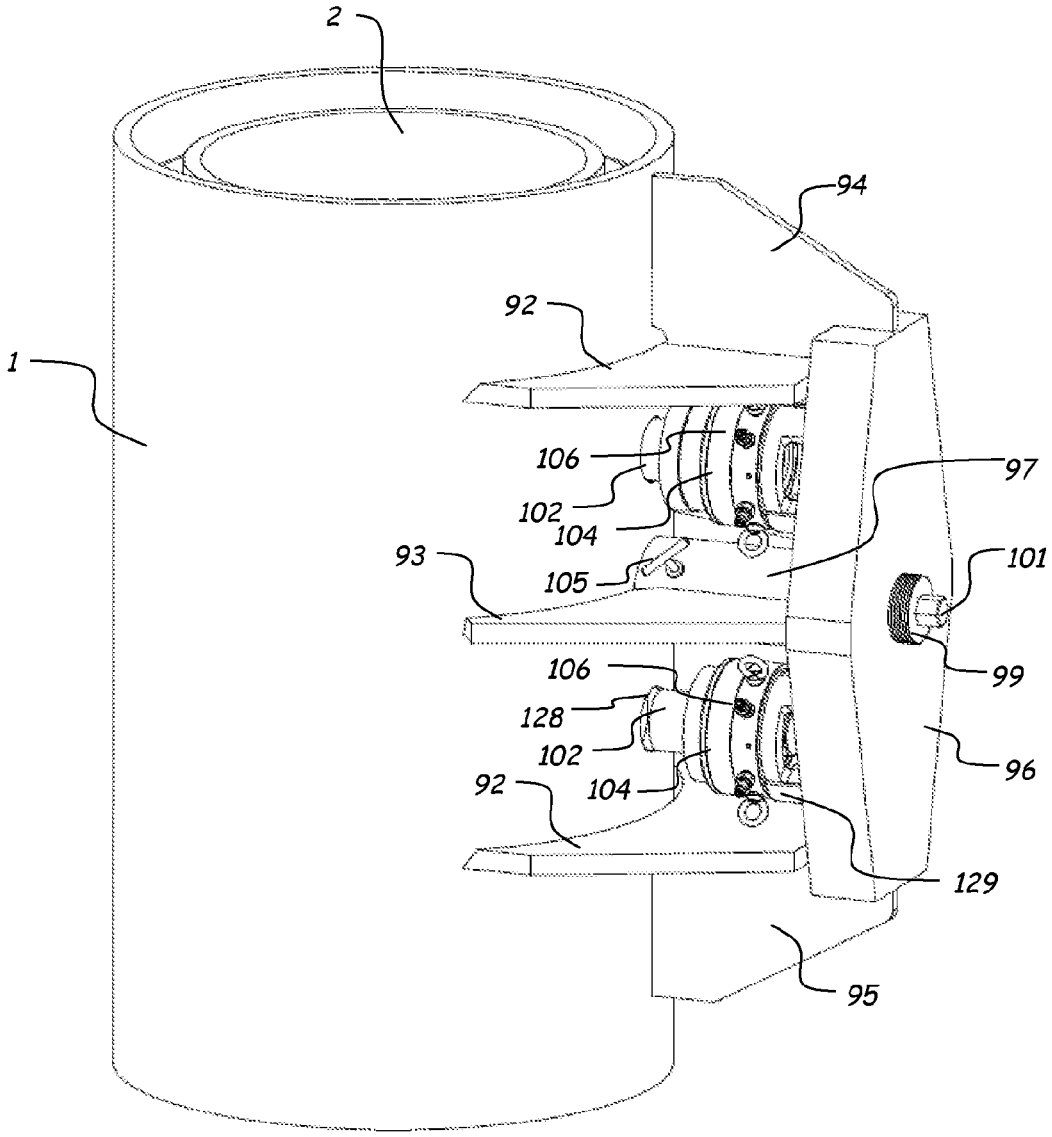
FIG. 19 shows an alternative clamping arrangement with a connector frame having a reaction plate having a single threaded hole with a single threaded locking pin aligned perpendicular to the axis of the concentrically arranged first and second members.

In FIG. 19 the reaction plate (96) has a single threaded hole with a single threaded locking pin (99) aligned perpendicular to the axis of the concentrically arranged internal tubular (2) and the outer tubular (1). The end of the locking pin a has a shaped projection in the form of a hexagonal or square bar over which a tool may be placed to assist rotation of the locking pin. This rotation will advance or retract the locking pin towards or away from an internal pad.

The reaction plate is fixed to the outer tubular (1) via a framework consisting of horizontal plates (92, 93) and vertical stiffeners (94,95). A tubular sleeve (97) may be used to house the locking pin (99) providing guidance and also providing a means to contain preservatives to maintain serviceability of the locking pin and associated threaded surfaces. The pad (15) is held in position via the bolt (18) attached to the locking pin (99). Two hydraulic cylinders (104) are shown between the reaction plate (96) and the outer tubular (1). The hydraulic cylinders have integral thrust rods (102) that are attached to the hydraulic cylinders. The thrust rods pass through openings (128) in the outer sleeve (1) allowing direct bearing onto the back of the pad (15).

Figure 20:
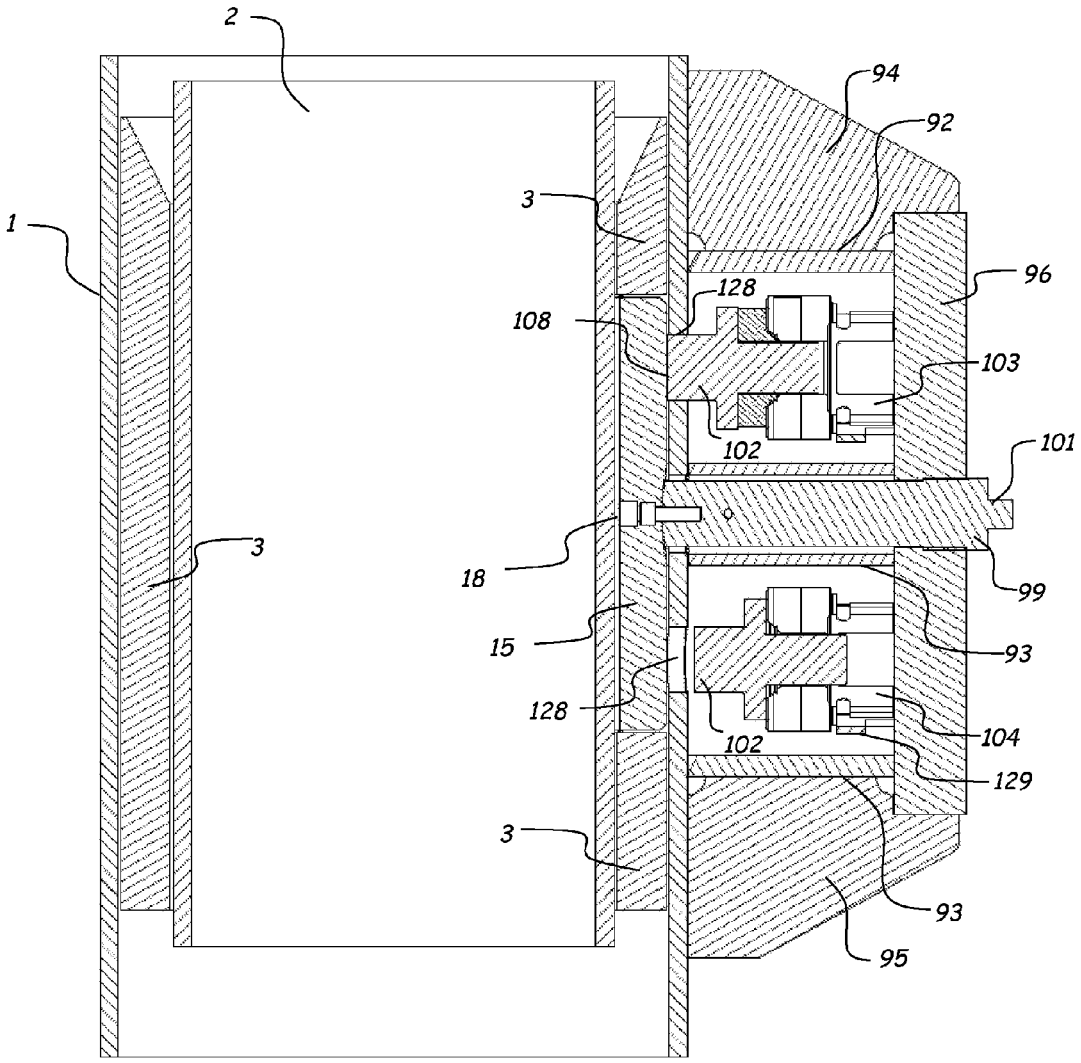
FIG. 20 shows a longitudinal section through the clamping arrangement depicted in FIG. 19.

FIG. 20 shows a longitudinal section through the connection. The hydraulic cylinders are located on plates (129) to align the piston (106) with the outer sleeve hole (128). Pressurised hydraulic fluid may be introduced via inlet port (106) to move the piston (102) forward to push the pad (15) against the inner tubular (2) and thereby introduce clamping and deformation load of the inner tubular (2) against the collar (3). The introduction of equal pressure in the two hydraulic cylinders simultaneously, via an hydraulic hose (not shown) advances the pad against the inner tubular with equal load. Application of the required clamping load will advance the pad and shear the bolt (105) allowing subsequent free rotation of locking pin (99). Whilst hydraulic pressure is maintain the locking pin (99) is rotated to close the gap between the forward end of the locking pin (108) and the back face of the pad (15). On release of the hydraulic pressure in the system the deformed shape of the inner tubular (2) and the clamping load for the system is maintained. The hydraulic cylinders may then be withdrawn and recovered leaving the connector locked.

It will be appreciated that this arrangement of hydraulic cylinders forming part of the connector frame can be an alternative arrangement to the requirement of a tool as described in relation to the other arrangements described herein.

In connection with any of the arrangements described herein, there optionally can be the use of a threaded collared boss to improve serviceability of the above connector by allowing introduction of Corrosion Resistant Alloy (CRA) threaded elements.

Figure 21:
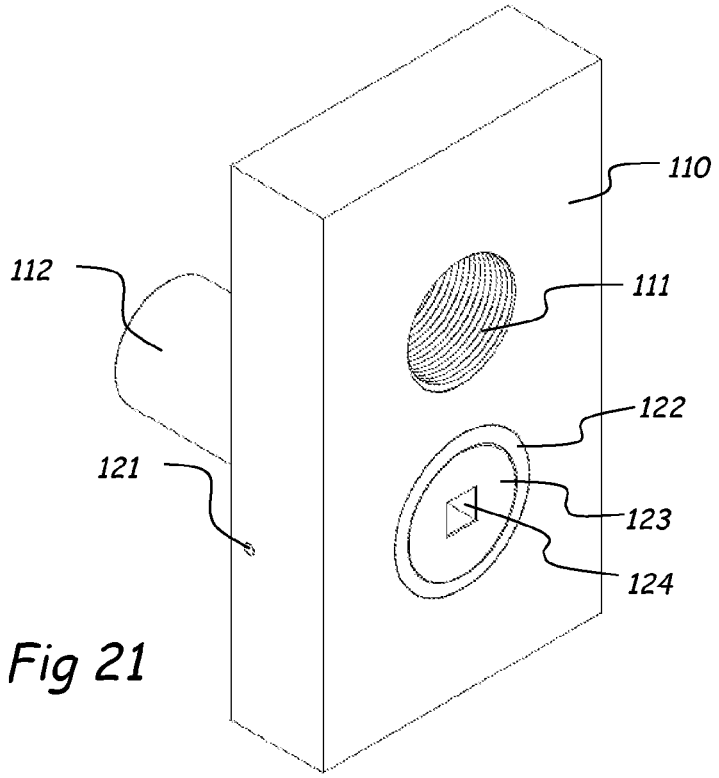
FIGS. 21 and 22 show a locking pin with a threaded section that engages with the internal thread of a shouldered boss.
Figure 22:
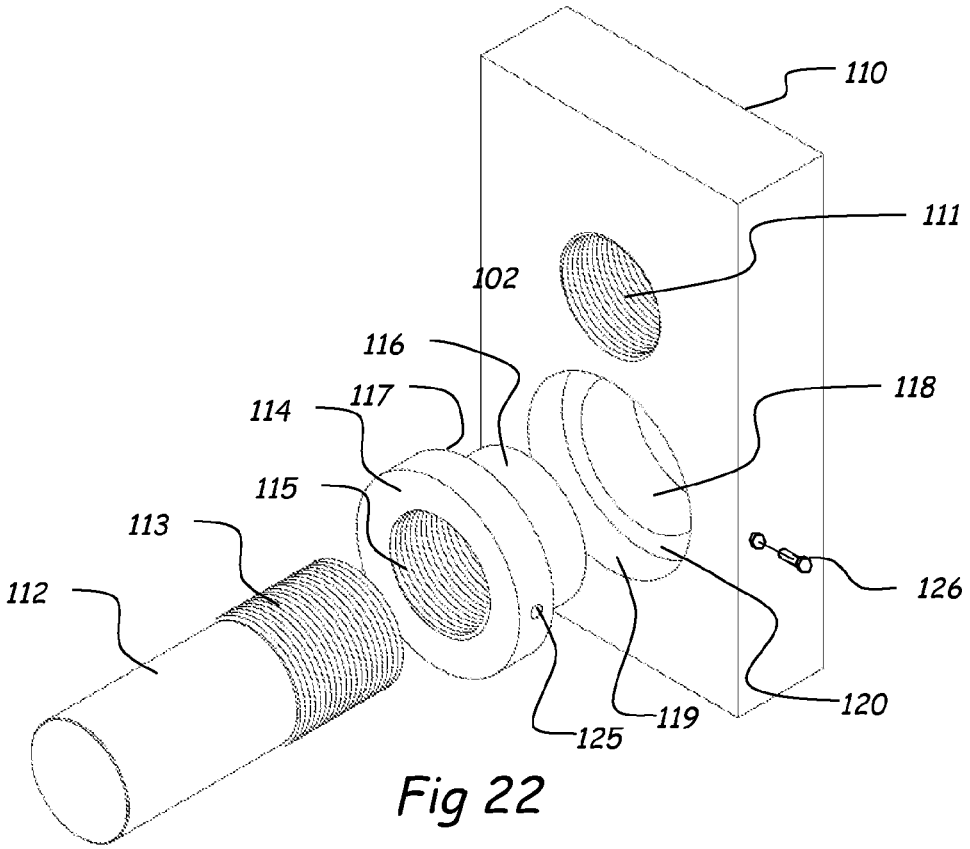

FIGS. 21 and 22 shows a CRA locking pin 112 with a threaded section (113) that engages with the internal thread (115) of a CRA shouldered boss (114). The reduced section of the collared boss (116) provides a bearing shoulder (117). This shoulder (117) bears against a similar face (120) formed by the stepped opening (118,119) machined within the reaction plate (110) with the collar larger diameter (114) fitting closely within the larger diameter opening (119) of the stepped hole and the smaller diameter (116) sitting within the smaller diameter opening (118) of the stepped hole. In this way the CRA material of the locking pin thread (113) and the boss thread (115) are in direct contact and the resulting corrosion will be minimal ensuring rotation of the locking pin following prolonged exposure to seawater. Rotation of the collar (114) during rotation of the locking pin (112) will be prevented by retaining screw (126) within drilled and tapped hole (125) in the collar (114). Equally a threaded dowel would be a suitable alternative.

In one preferred aspect of the tool of the present invention, there is provided the use of a spring or multiple springs set within a pressure inducing member (e.g. the hydraulic cylinder assembly) for returning the piston to the original retracted position.

Figure 23:
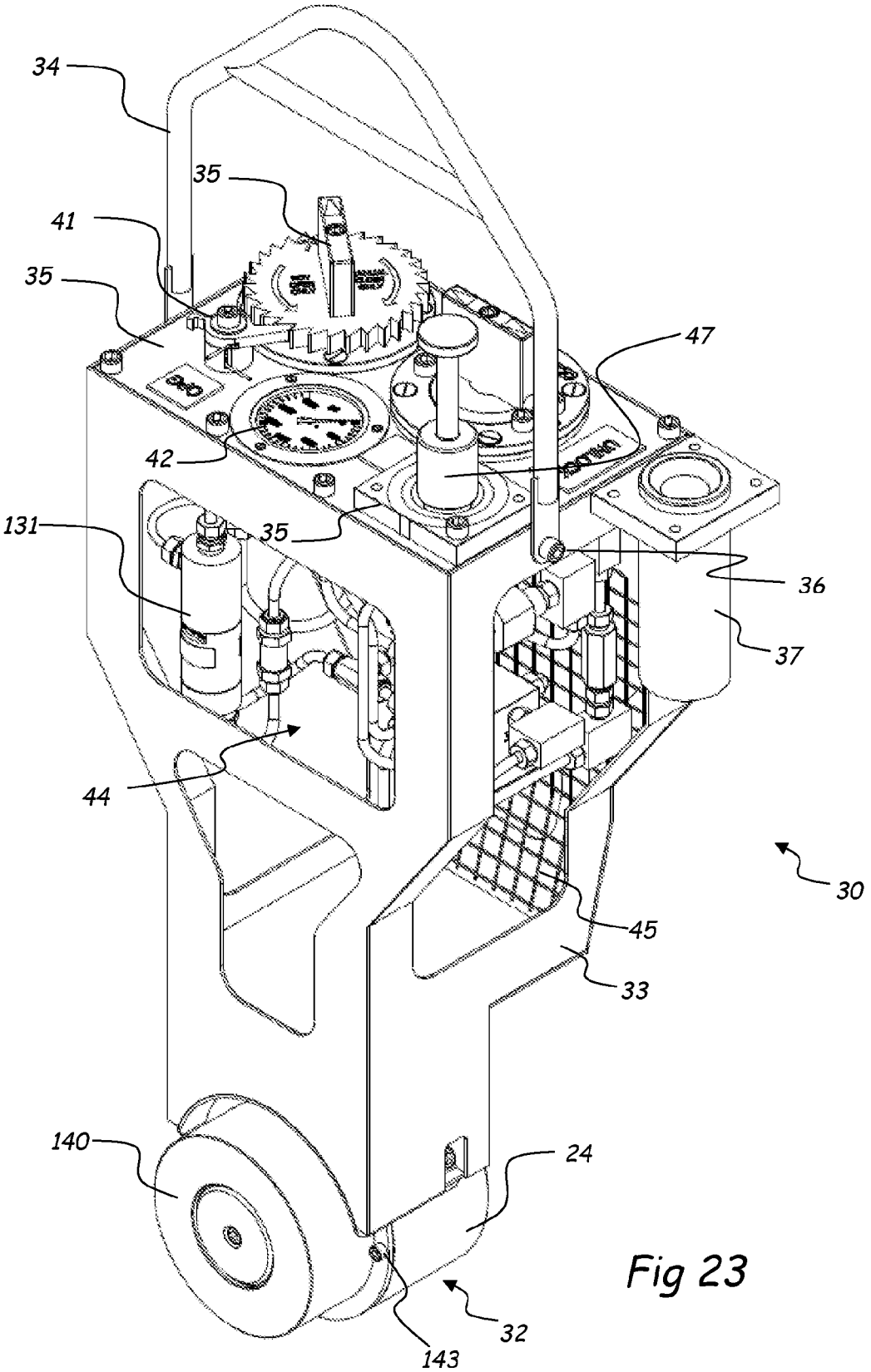
FIG. 23 shows a tool (comprising a pressure inducing member) from a reverse position.

FIG. 23 shows the tool (30) from the reverse position. This view repeats details shown in e.g. FIGS. 1, 3 and 4 but without the connector (20) mounted on the outer tubular (1). The view shows the pressure intensifier (131). Set within the hydraulic system (44). The hydraulic cylinder (32) also shows a spring cowling (140) fixed to the cylinder body (24) e.g. using bolts (143).

Figure 24:
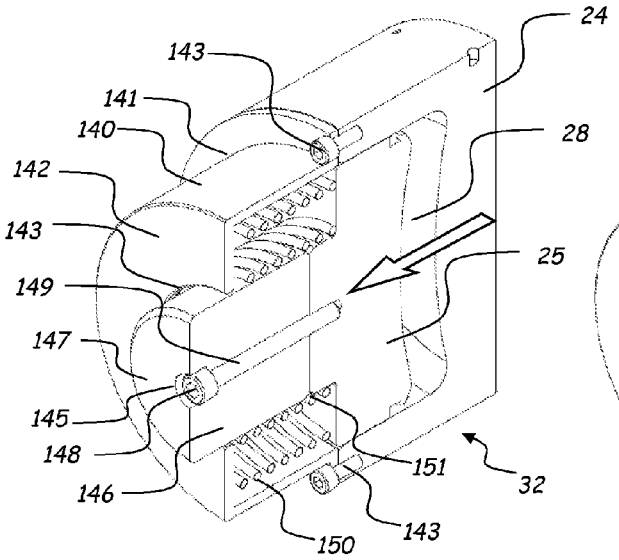
FIG. 24 shows a cross section through the middle of a hydraulic cylinder assembly of a tool in the pressurized state with the void between the piston and the cylinder body filled with fluid under pressure so that the piston face is forward of the spring cowling face.
Figure 25:
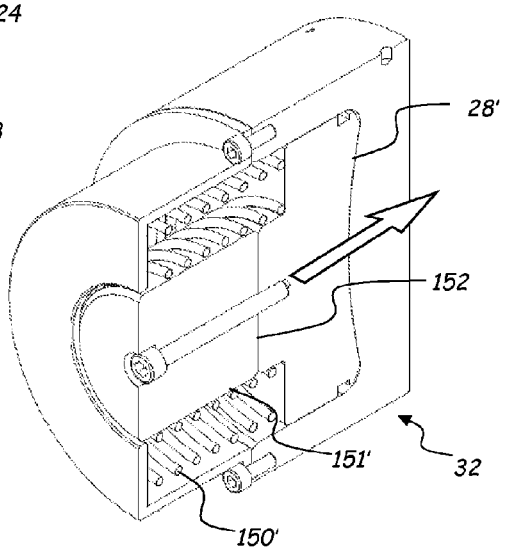
FIG. 25 shows the hydraulic cylinder assembly of FIG. 24 in a state of being depressurized.

FIG. 24 shows a cross section through the middle of the hydraulic cylinder assembly (32) in the pressurised state with the void (28) between the piston a (25) and the cylinder body (24) filled with fluid under pressure so that the piston face (147) is forward of the spring cowling face (142). Under this condition the spring 150 or springs (150 and 151) are in a compressed condition. In this view the piston (25) has a piston extension piece (146) mounted on the front of the piston (152) using one or more bolts (149). The bolt head (148) is sunk into a recess (145) set into the face of the piston extension piece (146). It may be that the front face (147) is sloping to allow easy separation from the thrust rod (17 on FIG. 12). Alternatively this extension piece (146) may be integral with the piston (25). On depressurising of the hydraulic fluid (see FIG. 25) the compressed springs (150 and 151) will have sufficient stored energy to return to the former shape (150' and 151') and the piston gap (28) will reduce to zero (28').

It is appreciated that the spring arrangement described here is indicative and this function could equally be served using for example a series of small diameter springs disposed securely around the full circumference of the hydraulic cylinder set between the recessed face of the piston and the inside face of the cowling.

Figure 26:
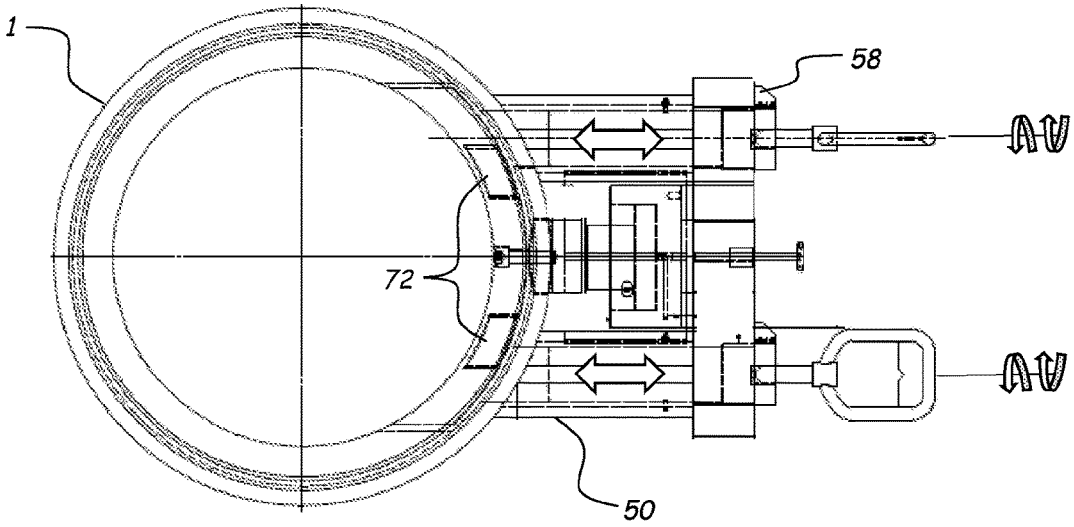
FIGS. 26 and 27 show an arrangement of the clamping arrangement similar to that described and shown in FIGS. 9 and 10 but the locking members (pins) are arranged to move in a direction that is orthogonal to the longitudinal axis of the first member rather than radial.
Figure 27:
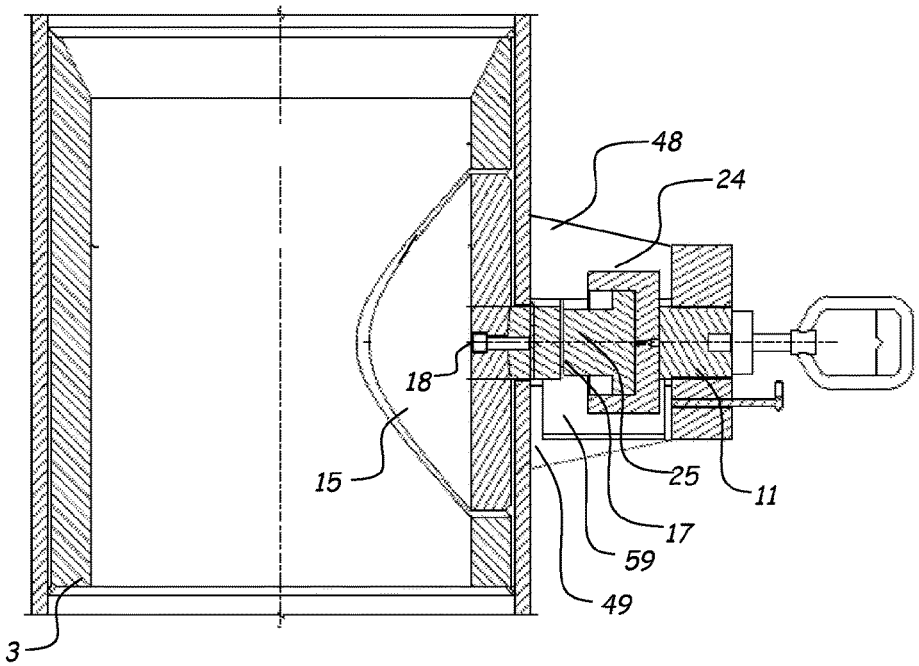

FIGS. 26 and 27 show an arrangement of the invention similar to that described and shown in FIG. 9 and FIG. 10 but the locking members (pins) are arranged to move in a direction that is orthogonal to the longitudinal axis of the first member rather than radial.

There are now described some preferred embodiments of the invention.

E1. The locking arrangement utilises at least one threaded Locking Pin to maintain the deformation in the Inner Tubular. The threaded Locking Pin is located in a threaded hole set in a Reaction Plate tied to the outer Tubular via a framework. One end of the Locking Pin is contactable with the outside of the Pad. The other ends of the Locking Pin passes through the Reaction Plate and is accessible from outside of the Reaction Plate allowing external engagement of the Locking Pin and thereby permitting rotation and subsequent axial movement of the threaded Locking Pin relative to both the Reaction Plate and the Pad. This axial movement allows any gap between the end of the Locking Pin and the Pad to be either closed or opened following deformation of the Inner Tubular. Following closure of this gap the hydraulic cylinder may be depressurised and removed. Typically this would allow the Inner Tube to return to the original circular shape but the Locking Pin prevents this. By maintaining this deformation the heavy clamping force is largely maintained and thereby the clamp remains engaged or 'locked'.

E2. As with E1 but a threaded block is attached to the Reaction Plate. Again the Locking Pin is accessible at the outer end allowing relative axial movement to close or open the gap between the Locking Pin and the back of the Bearing Pad E3. As with E1 or E2 the Locking Pins are aligned radially to the concentric centre of the axes of the connected tubular members, this being an efficient means of maintaining the deformed shape of the inner tubular as it prevents rotation of the pad and subsequent relaxation of the contact forces E4. As with E1-3 but the Locking Pins are at the same elevation as the applied clamping force (Thrust Rod), this being an efficient means of maintaining the deformed shape of the inner tubular as it prevents rotation of the pad and subsequent relaxation of the contact forces once the initial clamping force is removed.

E5. As with E1-4 but the Locking Pins are fully threaded and encased in a solid threaded section, this being an efficient means of maintaining the deformed shape of the inner tubular by minimising the relaxing strain in the Locking Pin due to its continual threaded engagement along its full length E6. As with E1-5, wherein the exposed ends of the Locking pins may have a suitably shaped (square or hexagonal) opening or projection to allow docking of a removable operator or handle suitable for diver or ROV use E7. As with E1-6, wherein adjacent to the external end of the Locking Pin a graduated marker or scale may be fixed to the Reaction Pad to allow visual reference to the amount of axial movement of each Locking Pin E8. As with E1-7, wherein a heavy load distribution pad may be introduced at the back of the Bearing Pad used to improve dispersion of the loads and reduce localised plastic deformation of both pad and pile. This reduces the losses in the system when load is transferred to the Locking Pin E9. As with E1-8, wherein the Collar Hole has a close fitting Pad that permits forward and reverse travel only for the Pad in a direction perpendicular to the axis of the Inner Tubular. To assist the close fitting requirement of the Pad in the Collar Hole an arrangement of Spacer Plates may be used. These Spacer Plates may be fixed to either the external edge of the Pad or the internal edge of the Collar Hole.

E10. A Tool to deliver the clamping load to the Thrust Rod will include an Hydraulic Cylinder. This may bare against a threaded Hydraulic Cylinder Release Pin set within and projecting from the Reaction Pad. On depressurisation of the Cylinder the Release Pin may be rotated to reduce the projection and thereby create a gap that may allow the Tool and attached Hydraulic Cylinder to be easily withdrawn.

E11. The Tool in E10 includes hydraulic tubing and equipment housed within a protective framework or compartment.

E12. The hydraulic tubing and equipment in E10 is suspended from the top or side plate and may be preassembled with full access prior to being attached to the remainder of the protective compartment. This allows ready removal and maintenance of the hydraulic components.

E13. The tool of E10-12, wherein the Hydraulic cylinder may be suspended in a protective shroud at the bottom of the Tool E14. The tool of E13, wherein the protective compartment is able to contain buoyant material in rigid preformed units in a shape sympathetic to the shape of the compartment or in loose form. The loose form material may be in the form of minispheres or microspheres or cubes or other pre-formed geometric shape that are compatible to allow efficient packing within the compartment and between the hydraulic components and tubing.

E15. The tool of E13-14, wherein the Protective compartment may have perforated sides in order to allow free drainage of the compartment and also allow cleaning of the buoyant material.

E16. The tool of E10-15, wherein the valve stem or other fragile components within the valve may be protected from over torquing and damage by permitting only rotation in the opening direction. This will protect the valve stem from damage. The single direction rotation will be ensured by slipping a circular teethed ratchet plate over the valve handle and setting a pawl to prevent inadvertent rotation in the closing direction E17. The tool of E10-15, wherein the external shape of the Tool Compartment shall assist entry or docking of the Tool into the Tool Receptacle within the Connector Frame E18. As with E1-17, wherein the sloping interface between the piston and Thrust pin is either a sloping machined face or a cap plate that can be fixed to the piston or Thrust pin to create a sloping interface. The sloping interface arranged to allow a gap to develop the instance the RRU is lifted E19. As with E1-18, wherein the radial pair of aligned locking pins set at the same elevation as the Thrust Pin. This is aligned with the Thrust Pin to minimise losses on depressurisation. This is because there is no appreciable rotation of the pile on depressurisation E20. As with E1-19, wherein the use of a sleeve or sleeves to protect the locking pin and provide a maintainable annulus to contain preservative fluid or grease to prevent or minimise corrosion E21. As with E1-20, wherein the use of a threaded boss and or threaded Locking Pin in a CRA material. This will allow the device to be unlocked and re locked at a later date.

E22. As with E1-21, wherein the hydraulic cylinder shall incorporate at least one spring contained within a cowling to force the piston into the retracted position when the hydraulic fluid pressure is removed.

The invention claimed is:

1. A system for preventing the movement of a clamping member, the system comprising:

a first member having fixed to it a connector frame, said connector frame comprising a reaction plate and at least one locking frame;

said first member comprising a clamping member, said first member having a longitudinal axis and wherein said clamping member is moveable towards and away from said axis;

said connector frame being arranged to removably accept a tool with pressure inducing means positionable between the reaction plate and the clamping member;

at least one locking member each supported via said at least one locking frame on said first member and each being contactable with said clamping member;

the locking frame being arranged such that each of the at least one locking members is offset from the pressure inducing means of the tool when the tool is in position between the reaction plate and the clamping member;

wherein each of said at least one locking member is moveable towards the clamping member in order to prevent said clamping member from moving away from said longitudinal axis to its initial position.

2. The system of claim 1, wherein said at least one locking member is moveable towards the clamping member after the clamping member has been moved towards the longitudinal axis of the first member.

3. The system of claim 1, wherein said at least one locking member is a pair of locking members.

4. The system of claim 3, wherein said pair of locking members are positioned in the same, or substantially the same, plane perpendicular to the longitudinal axis of the first member, or wherein said pair of locking members are positioned in the same, or substantially the same, plane parallel to the longitudinal axis along the first member.

5. The system of claim 3, wherein said pair of locking members are positioned so that their longitudinal axes intersect substantially along the longitudinal axis of the first member.

6. The system of claim 1, wherein said at least one locking member is orientated orthogonally to the longitudinal axis of the first member.

7. The system of claim 1, wherein said at least one locking member comprises a tail portion that is contactable with said clamping member and a head portion that is accessible from outside of the first member, preferably wherein the tail portion of the at least one locking member has a convex/concave profile, wherein said tail portion interacts with a complementary concave/convex profiled part, respectively, of the clamping member in order to accommodate misalignment between the locking member and the clamping member.

8. The system of claim 1, wherein said at least one locking member comprises a plurality of parts, wherein said plurality of parts are integral with each other, or are in moveable association with each other to allow the locking member to articulate.

9. The system of claim 1, wherein said at least one locking member comprises at least a portion that is threaded, said threaded portion corresponding to a complementary threaded portion on said at least one locking frame and/or on said first member, optionally wherein at least the threaded portion of the locking member is made from a corrosion resistant material, and optionally wherein the locking frame comprises a removable threaded boss, preferably wherein said boss is made from a corrosion resistant material.

10. The system of claim 1, wherein said at least one locking frame comprises at least one sleeve, each of said at least one sleeves surrounding at least a substantial part of the length of each of said at least one locking members.

11. The system claim 1, wherein said at least one locking member is substantially fully threaded along its length, wherein said at least one locking frame comprises a threaded section extending for at least most, preferably all, of the length of the locking member when said locking member is positioned in the frame prior to the movement of the clamping member towards the longitudinal axis of the first member.

12. The system of claim 1, wherein adjacent to the head portion of said at least one locking member is a graduated marker or scale to allow visual reference to the amount of axial movement of said locking member and/or a reference line or mark on a locking member and locking frame to allow the amount of rotation of the locking member to be determined and thereby the amount of axial movement.

13. The system of claim 1, wherein said first member further comprises a collar, and wherein said clamping member extends through said collar, optionally wherein said clamping member is formed from at least a part of said collar, and optionally wherein the collar or clamping member further comprises an arrangement of spacer plates to prevent any significant movement of the clamping member other than in a direction perpendicular to the longitudinal axis of the first member.

14. The system of claim 1, wherein said system further comprises a second member, wherein said second member is placed within said first member and wherein said clamping member exerts force on said second member when said clamping member is moved towards the longitudinal axis of said first member.

15. The system of claim 1, wherein said clamping member is connected to at least one thrust rod, preferably wherein each of the at least one locking member is offset from the longitudinal axis of the at least one thrust rod.

16. The system of claim 15, wherein the at least one thrust rod is one thrust rod, and wherein said system comprises a pair of locking members, said locking members being positioned so that their longitudinal axes intersect substantially along the longitudinal axis of the thrust rod.

17. The system of claim 15, wherein the at least one thrust rod is two thrust rods, and wherein the system comprises two thrust rods and one locking member.

18. The system of claim 15, wherein said thrust rod, or a cap plate that is affixed to the thrust rod, comprises a sloping face that interfaces with a complementary sloping face on a pressure inducing member.

19. The system of claim 1, wherein the connector frame further comprises an adjustable surface of the Reaction Plate.

20. The system of claim 1, wherein the system comprises a second member placed within said first member and each of said at least one locking member comprises means preventing it from passively moving away from the second member in order to prevent loss of the clamping force on the second member.

* * * * *